US008843004B2

(12) United States Patent
Satoh et al.

(10) Patent No.: US 8,843,004 B2
(45) Date of Patent: Sep. 23, 2014

(54) IMAGE FORMING APPARATUS

(71) Applicants: Osamu Satoh, Kanagawa (JP); Yasushi Nakazato, Tokyo (JP); Kohji Ue, Kanagawa (JP); Jun Yamane, Kanagawa (JP)

(72) Inventors: Osamu Satoh, Kanagawa (JP); Yasushi Nakazato, Tokyo (JP); Kohji Ue, Kanagawa (JP); Jun Yamane, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/644,453

(22) Filed: Oct. 4, 2012

(65) Prior Publication Data

US 2013/0028615 A1 Jan. 31, 2013

Related U.S. Application Data

(62) Division of application No. 12/360,491, filed on Jan. 27, 2009.

(30) Foreign Application Priority Data

Feb. 5, 2008 (JP) ..... 2008-025631

(51) Int. Cl.
*B41J 29/38* (2006.01)
*G03G 15/00* (2006.01)

(52) U.S. Cl.
CPC .. *G03G 15/5029* (2013.01); *G03G 2215/00734* (2013.01); *G03G 2215/00776* (2013.01); *G03G 2215/00738* (2013.01)
USPC ..... 399/22; 399/33; 399/21

(58) Field of Classification Search
USPC ..... 399/388, 389, 22, 33, 400; 73/12.02, 73/12.03, 12.04, 12.05, 12.06, 12.11, 73/12.13
See application file for complete search history.

(56) References Cited

U.S. PATENT DOCUMENTS

| | | | | |
|---|---|---|---|---|
| 4,607,954 | A * | 8/1986 | Osaka et al. | 399/55 |
| 7,110,917 | B2 | 9/2006 | Matsuura et al. | |
| 2005/0006285 | A1* | 1/2005 | Watanabe et al. | 209/534 |
| 2005/0286916 | A1 | 12/2005 | Nakazato et al. | |
| 2006/0024096 | A1* | 2/2006 | Kimura | 399/325 |
| 2006/0275045 | A1* | 12/2006 | Kawasaki et al. | 399/45 |
| 2007/0127934 | A1* | 6/2007 | Shoji et al. | 399/9 |
| 2008/0048392 | A1 | 2/2008 | Hamahashi | |

FOREIGN PATENT DOCUMENTS

| | | |
|---|---|---|
| JP | 5-313517 | 11/1993 |
| JP | 6-138736 | 5/1994 |
| JP | 9-124212 | 5/1997 |

(Continued)

OTHER PUBLICATIONS

Author: Alava et al. Title: The physics of paper Date: Year 2006 Pertinent pp. 1, 2 and 32 (see paragraph 5).*

(Continued)

*Primary Examiner* — Daniel J Colilla
*Assistant Examiner* — Ruben Parco, Jr.
(74) *Attorney, Agent, or Firm* — Oblon, Spivak, McClelland, Maier & Neustadt, L.L.P.

(57) ABSTRACT

An area calculating unit calculates an image area of a toner image formed on a sheet recording member. A behavior detecting unit detects behavior of the recording member fed out of a conveying nip formed by a pair of conveying members. A thickness obtaining unit obtains thickness information of the recording member. An index calculating unit calculates an index value indicating windability of the recording member with respect to the conveying members based on the image area, the behavior, and the thickness information.

7 Claims, 16 Drawing Sheets

(56) References Cited

FOREIGN PATENT DOCUMENTS

| | | | | | |
|---|---|---|---|---|---|
| JP | 09-251255 | | | 9/1997 | |
| JP | 09251255 | A | * | 9/1997 | ..... G03G 15/20 |
| JP | 2003-323013 | | | 11/2003 | |
| JP | 3512569 | | | 1/2004 | |
| JP | 2005-227322 | | | 8/2005 | |
| JP | 2005227322 | A | * | 8/2005 | ..... G03G 15/20 |
| JP | 2005257781 | A | * | 9/2005 | ..... G03G 21/00 |
| JP | 2006-11174 | | | 1/2006 | |
| JP | 2006-267193 | | | 10/2006 | |
| JP | 2007-22773 | | | 2/2007 | |
| JP | 3923084 | | | 3/2007 | |
| JP | 2007-108618 | | | 4/2007 | |
| JP | 2007108618 | A | * | 4/2007 | ..... B41J 29/38 |
| JP | 2007-144666 | | | 6/2007 | |
| JP | 2008-102261 | | | 5/2008 | |
| JP | 2008-107639 | | | 5/2008 | |

OTHER PUBLICATIONS

Office Action issued Feb. 17, 2012 in Japan Application No. 2008-025631.

Author: Alava et al. The Physics of Paper Date: Year 2006 Pertinent pp. 1, 2 and 32 (see paragraph 5).

* cited by examiner

IMAGE FORMING APPARATUS

CROSS-REFERENCE TO RELATED APPLICATIONS

The present application is a Divisional application of U.S. Ser. No. 12/360,491 filed on Jan. 27, 2009, the entire contents of which is incorporated herein by reference. The present application also claims priority to and incorporates by reference the entire contents of Japanese priority document 2008-025631 filed in Japan on Feb. 5, 2008.

BACKGROUND OF THE INVENTION

1. Field of the Invention

The present invention relates to an image forming apparatus that conveys a recording member during formation of a toner image or after the toner image is formed by a toner-image forming unit, by nipping the recording medium in a transfer nip formed by a pair of conveying members abutting against each other while making a surface movement.

2. Description of the Related Art

In image forming apparatuses related to the present invention, a sheet-like recording member inserted into a transfer nip formed by a pair of conveying members such as a combination of a photoconductor and a transfer roller, or a pair of fixing rollers can wind around one of the conveying members due to viscosity of a toner image on the surface thereof or electric charge. If severe winding occurs, recording paper can be wound into a unit that includes the conveying members, and it requires maintenance work by a service engineer. Specifically, the image forming apparatus generally has a door for exposing a conveying path to the outside according to need, and the recording paper as the recording member blocked in the conveying path can be easily removed from a space opened by the door. However, the recording paper wound in a process unit containing the photoconductor as the conveying member or a fixing unit containing the fixing roller as the conveying member cannot be removed unless the unit is disassembled. Because a certain degree of knowledge is required for unit disassembling, its user cannot handle the problem and needs help of a service engineer.

Winding of the recording paper into the conveying member is largely associated with wearing of the conveying member. The surface of the conveying member in an initial state has excellent smoothness, and can demonstrate excellent releasability with respect to the toner having viscosity or electric charge. Therefore, winding of the recording paper with respect to the conveying member hardly occurs. However, when the smoothness of the conveying member is lost with long time use (when the conveying member wears), winding can easily occur.

In the fixing unit that fixes the toner image on the recording paper, the toner image is softened by heating to increase the viscosity thereof. Therefore, winding of the recording paper around the fixing roller tends to occur. Accordingly, there is a type of an image forming apparatus in which the recording paper advanced close to wind around the fixing roller is forcibly peeled off from the fixing roller by a separation claw installed adjacent to the fixing roller. However, even with the separation claw, winding of the recording paper into the unit cannot be completely avoided. When adhesion between the toner image and the fixing roller considerably increases due to formation of a full-page solid toner image, the recording paper can slip through between the separation claw and the fixing roller.

Therefore, in Japanese Patent Application Laid-open No. 2007-108618, the inventors have proposed an image forming apparatus as described below. That is, the image forming apparatus detects behavior of recording paper fed out of an outlet of a fixing nip formed by a pair of fixing rollers, based on a time-series detection result obtained by a distance sensor that detects a distance between the recording paper and the sensor itself. The image forming apparatus then determines a wearing of the fixing roller based on the behavior, an image area ratio of the toner image, and a thickness of the recording paper, and urges the user to replace the fixing roller based on the result. When the fixing roller wears and the recording paper easily tends to wind around the fixing roller, the recording paper discharged from the outlet of the fixing nip is not separated promptly from the fixing roller, and starts to exhibit a behavior following the surface of the fixing roller. When the recording paper begins to exhibit such a behavior, the user is urged to replace the fixing roller, thereby enabling to prevent before an occurrence of winding of the recording paper due to continuous use of the worn fixing roller.

The following is the reason why the image area ratio of the toner image and the thickness of the recording paper are used in addition to the behavior of the recording paper fed out of the outlet of the fixing nip as the parameter for determination of the wearing of the fixing roller. That is, easiness of winding around the fixing roller of the recording paper fed out of the outlet of the fixing nip is associated with an image area of the toner image formed on the recording paper and stiffness of the recording paper other than surface smoothness of the fixing roller. Even if the wearing of the fixing roller (degradation degree of the surface smoothness) is the same, the behavior of the recording paper after passing the outlet of the fixing nip becomes different between a case having a relatively large area and a case having a relatively small area of the toner image, which demonstrates the viscosity and an electrostatic force. As the area of the toner image becomes larger, the time required for separation of the recording member fed out of the fixing nip from the surface of the fixing roller (hereinafter, "recording paper separation time") becomes longer. Further, the behavior of the recording paper fed out of the outlet of the fixing nip becomes different between a case of having a relatively strong stiffness and a case of having a relatively weaker stiffness of the recording paper. As the stiffness of the recording paper becomes weaker, the recording paper separation time becomes longer. Therefore, the wearing of the fixing roller is determined, comprehensively taking the image area of the toner image and the thickness of the recording paper into consideration in addition to the behavior of the recording paper.

However, in the image forming apparatus of Japanese Patent Application Laid-open No. 2007-108618, there is still a room for improvement as follows. That is, the thickness and stiffness of the recording paper have a certain degree of correlation; however, the correlation is not a strict proportional relationship. Even with the recording paper having the same thickness, the recording paper having a wider width demonstrates a stronger stiffness. Nevertheless, the wearing of the fixing roller is determined, regarding the thickness of the recording paper as the stiffness. Accordingly, a slight discrepancy has been generated between the determination result and the actual wearing.

SUMMARY OF THE INVENTION

It is an object of the present invention to at least partially solve the problems in the conventional technology.

According to one aspect of the present invention, there is provided an image forming apparatus including an image forming unit that forms a toner image on a sheet recording member, an area calculating unit that calculates an image area of the toner image, a pair of conveying members forming a conveying nip for conveying the recording member during the toner image is being formed or after the toner image is formed, a behavior detecting unit that detects behavior of the recording member fed out of the conveying nip, a thickness obtaining unit that obtains thickness information of the recording member, an index calculating unit that calculates an index value indicating windability of the recording member with respect to the conveying members based on at least the image area, the behavior, and the thickness information, and a wearing determining unit that determines wearing of the conveying member based on the index value. The image forming apparatus further includes a width obtaining unit that obtains width information of the recording member, and the index calculating unit calculates the index value further based on the width information as well as the image area, the behavior, and the thickness information.

Furthermore, according to another aspect of the present invention, there is provided an image forming apparatus including an image forming unit that forms a toner image on a sheet recording member, an area calculating unit that calculates an image area of the toner image, a pair of conveying members forming a conveying nip for conveying the recording member during the toner image is being formed or after the toner image is formed, a behavior detecting unit that detects behavior of the recording member fed out of the conveying nip, an index calculating unit that calculates an index value indicating windability of the recording member with respect to the conveying members based on at least the image area and the behavior, and a wearing determining unit that determines wearing of the conveying member based on the index value. The image forming apparatus further includes a stiffness obtaining unit that obtains bending stiffness of the recording member, and the index calculating unit calculates the index value further based on the bending stiffness as well as the image area and the behavior.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained in detail below with reference to the accompanying drawings.

A copying machine that forms an image by an electrographic process is explained as an image forming apparatus according to a first embodiment of the present invention.

Figure 1:
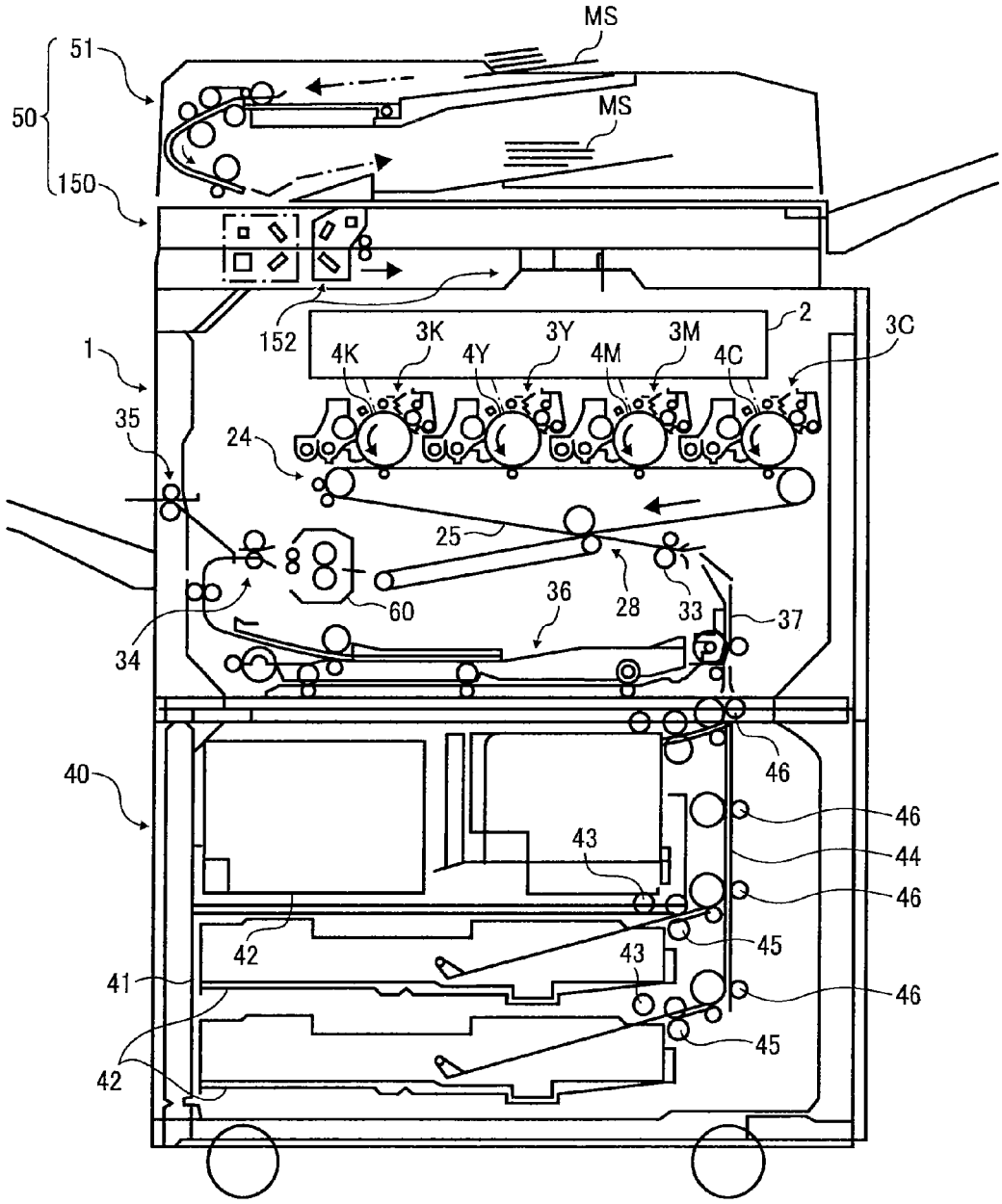
FIG. 1 is a schematic configuration diagram of a copying machine according to a first embodiment of the present invention.

A basic configuration of the copying machine according to the first embodiment is explained first. FIG. 1 is a schematic block diagram of the copying machine. The copying machine includes a printer unit 1, a paper feeding unit 40, and an original conveying/reading unit 50. The original conveying/reading unit 50 includes a scanner 150 as an original reader fixed on the printer unit 1 and an automatic document feeder (ADF) 51 as an original conveying unit supported on the scanner 150.

The paper feeding unit 40 includes two paper feed cassettes 42 arranged in multistage in a paper bank 41, a delivery roller 43 that delivers recording paper from the paper feed cassette, a separation roller 45 that separates the delivered recording paper and supplies the recording paper to a paper feed path 44, and the like. The paper feeding unit 40 also includes a plurality of conveying rollers 47 that conveys the recording paper to a paper feed path 37 in the printer unit 1. The paper feeding unit 40 feeds the recording paper in the paper feed cassette to the paper feed path 37 in the printer unit 1.

Figure 2:
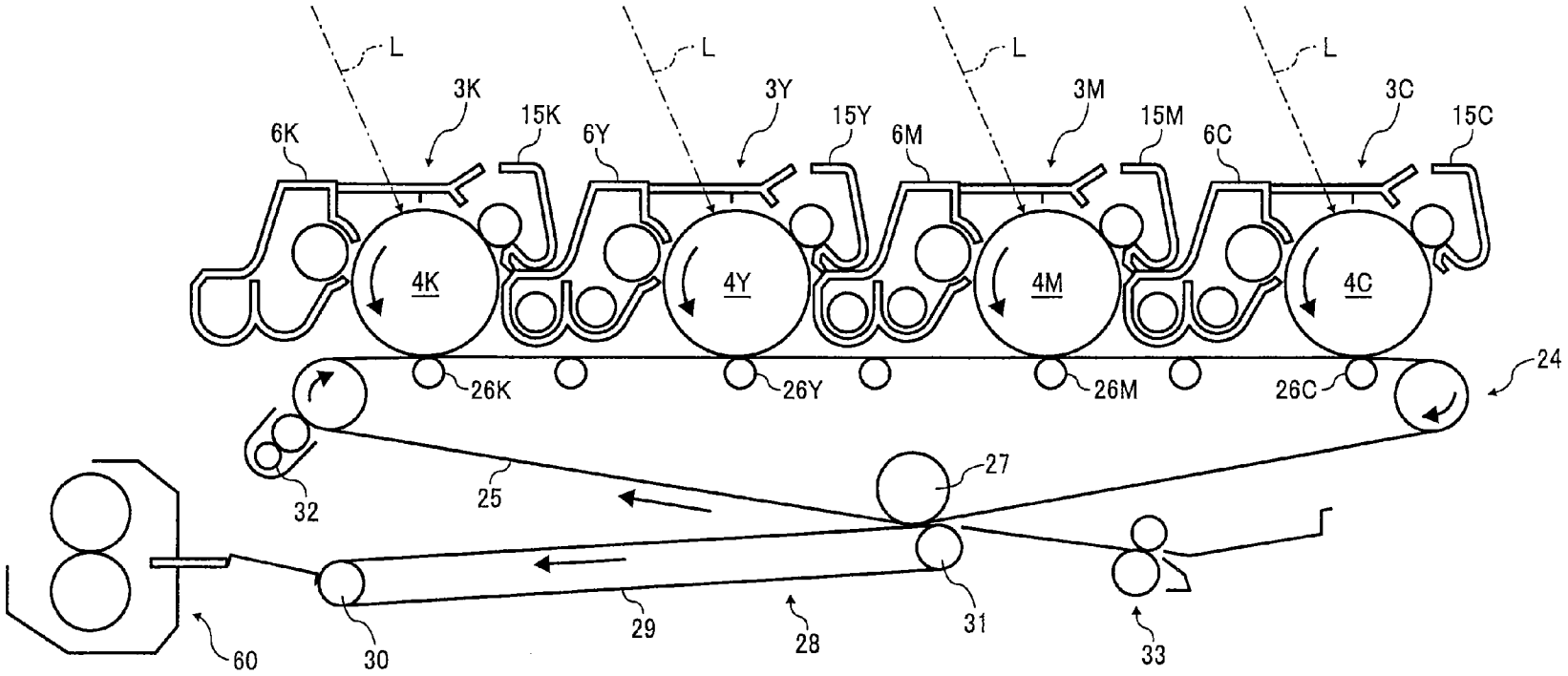
FIG. 2 is a partially enlarged configuration diagram of a part of an internal configuration of a printer unit in the copying machine in an enlarged scale.

FIG. 2 is a partially enlarged configuration diagram of a part of an internal configuration of the printer unit 1. The printer unit 1 includes four process units 3K, 3Y, 3M, and 3C that form a K, Y, M, and C toner image, respectively, a transfer unit 24, a paper conveying unit 28, a pair of registration rollers 33, a fixing unit 60, and the like. The printer unit 1 also includes an optical writing unit 2 shown in FIG. 1, a curl-removing roller group 34, a pair of paper-ejection rollers 35, a switch-back unit 36, the paper feed path 37, and the like, in addition to these units. The printer unit 1 drives a light source such as a laser diode or a laser emitting diode (LED) (not shown) arranged in the optical writing unit 2 to irradiate laser beams L toward drum-like four photoconductors 4K, 4Y, 4M, and 4C. An electrostatic latent image is formed on the surface of the photoconductors 4K, 4Y, 4M, and 4C due to the irradiation, and the latent image is developed to a toner image through a predetermined developing process. Subscript K, Y, M, and C attached to respective reference numerals indicate that it is a specification for black, yellow, magenta, and cyan.

The process units 3K, 3Y, 3M, and 3C respectively support, as shown in FIG. 2, the photoconductor as a latent image carrier and various devices arranged therearound as one unit on a common support body, and these process units is detachable with respect to the printer unit 1 body. Taking an example of the black process unit 3K, the process unit 3K includes the photoconductor 4K and a developing device 6K for developing the electrostatic latent image formed on the surface of the photoconductor 4K to a black toner image. The process unit 3K also includes a drum cleaning unit 15 that cleans a transfer residual toner adhered on the surface of the photoconductor 4K after passing through a primary transfer nip for black. The copying machine has a so-called tandem configuration in which the process units 3K, 3Y, 3M, and 3C are arranged opposite to an intermediate transfer belt 25 described later along a moving direction thereof.

Figure 3:
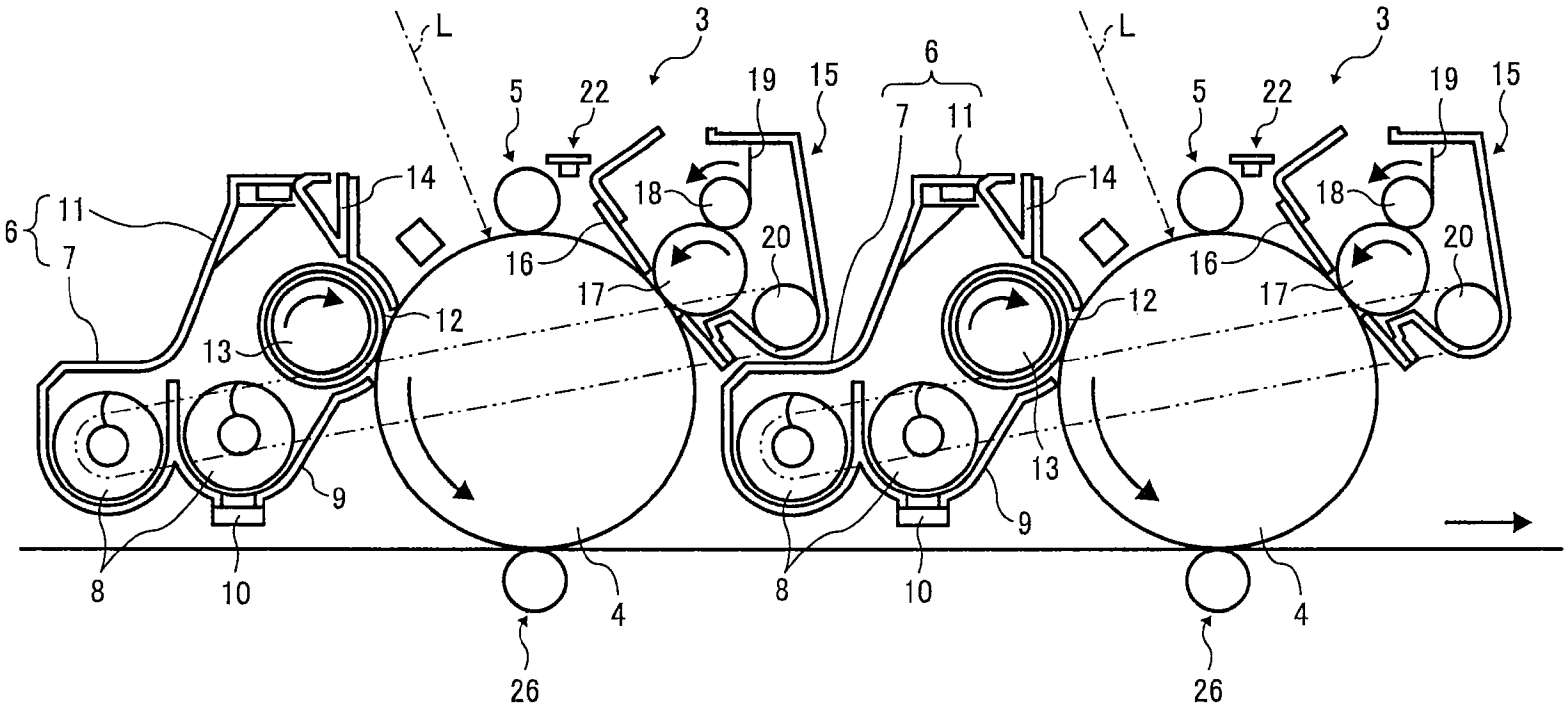
FIG. 3 is a partially enlarged diagram of a part of a tandem unit in the copying machine.

FIG. 3 is a partially enlarged diagram of a part of a tandem unit including four process units 3K, 3Y, 3M, and 3C. Because the process units 3K, 3Y, 3M, and 3C have substantially the same configuration except that the color of the toner to be used is different, the subscripts K, Y, M, and C added to the respective numerals are omitted in FIG. 3. As shown in FIG. 3, the process unit 3 includes a charging unit 23, the developing device 6, the drum cleaning unit 15, and a neutralizing lamp 22 around the photoconductor 4.

As the photoconductor 4, a drum-like photoconductor having a photosensitive layer formed thereon by applying an organic sensitive material having photosensitivity is used. An endless-belt like photoconductor can be also used.

The developing device 6 develops the latent image by using a two-component developer containing a magnetic carrier and a non-magnetic toner (not shown). The developing device 6 includes a stirring unit 7 that carries and supplies the developer to a developing sleeve 12 while stirring the two-component developer stored therein, and a developing unit 11 that transfers the toner in the two-component developer carried on the developing sleeve 12 to the photoconductor 4. As the developing device 6, a developing device that performs development by using a one-component developer not including the magnetic carrier instead of the two-component developer can be used.

The stirring unit 7 is provided at a position lower than the developing unit 11, and includes two conveying screws 8 arranged in parallel to each other, a partition plate provided between the screws, and a toner density sensor 10 provided at the bottom of a developing case 9.

The developing unit 11 includes the developing sleeve 12 facing the photoconductor 4 via an opening of the developing case 9, a magnet roller 13 unrotatably provided inside of the developing sleeve 12, a doctor blade 14 that brings the end thereof close to the developing sleeve 12, and the like. The developing sleeve 12 has a nonmagnetic rotatable cylindrical shape. The magnet roller 13 has a plurality of magnetic poles sequentially arranged from a position facing the doctor blade 14 toward the rotation direction of the developing sleeve. These magnetic poles respectively exert magnetism at a predetermined position in the rotation direction with respect to the two-component developer on the developing sleeve. Accordingly, the two-component developer transmitted from the stirring unit 7 is attracted to the surface of the developing sleeve 12 and carried thereon, and a magnetic brush is formed along a field line on the developing sleeve.

The magnetic brush is regulated to an appropriate thickness at the time of passing the position facing the doctor blade 14, with the rotation of the developing sleeve 12, and carried to a developing area facing the photoconductor 4. The magnetic brush then transfers the toner onto the electrostatic latent image by a potential difference between a developing bias applied to the developing sleeve 12 and the electrostatic latent image on the photoconductor 4 to thereby contribute to the development. The magnetic brush returns into the developing unit 11 again with the rotation of the developing sleeve 12, and is separated from the surface of the developing sleeve due to an influence of a repulsive magnetic field formed between the magnetic poles of the magnet roller 13 and then returned to the stirring unit 7. An appropriate amount of the toner is supplied to the two-component developer based on a detection result by the toner density sensor 10.

As the drum cleaning unit 15, the one pressing a cleaning blade 16 made of polyurethane rubber against the photoconductor 4 is used; however, any other type can be used. A fur brush 17 of contact electroconductive type that brings the outer circumference thereof into contact with the photoconductor 4, is used in the first embodiment for enhancing the cleaning property, which rotates in the direction of an arrow shown in FIG. 3. The fur brush 17 also has a function of scraping a lubricant from a solid lubricant (not shown) to make it a fine powder and applying the lubricant on the surface of the photoconductor 4. A metal field roller 18 that applies a bias to the fur brush 17 is rotatably provided in a direction of arrow in FIG. 3, and an end of a scraper 19 is pressed against the field roller 18. The toner adhered on the fur brush 17 is transferred to the field roller 18 to which the bias is applied, while the field roller 18 comes in contact with the fur brush 17 in a counter direction and rotates. After the toner is scraped by the scraper 19 from the field roller 18, the toner falls on a recovery screw 20. The recovery screw 20 carries the recovered toner toward an end of the drum cleaning unit 15 in a direction orthogonal to the sheet, and transfers the recovered toner to an external recycle conveying device 21. The recycle conveying device 21 delivers the transferred toner to the developing device 6 for recycling.

The neutralizing lamp 22 neutralizes the photoconductor 4 by a light irradiation. The surface of the photoconductor 4, which is neutralized, is uniformly charged by the charging unit 23, and subjected to an optical writing process by the optical writing unit 2. As the charging unit 23, the one that rotates a charging roller applied with a charging bias while making the charging roller abut against the photoconductor 4 is used. A scorotron charging unit that charges the photoconductor 4 in a non-contact manner can be used.

In FIG. 2, the K, Y, M, and C toner images are formed, respectively, on the photoconductors 4K, 4Y, 4M, and 4C in the process units 3K, 3Y, 3M, and 3C according to the process explained above.

The transfer unit 24 is arranged below the process units 3K, 3Y, 3M, and 3C. The transfer unit 24 causes the intermediate transfer belt 25 laid across in a tensioned condition by a plurality of rollers to abut against the photoconductors 4K, 4Y, 4M, and 4C to endlessly move in a clockwise direction in FIG. 3. Accordingly, the primary transfer nip for K, Y, M, and C is formed at which the photoconductors 4K, 4Y, 4M, and 4C abut against the intermediate transfer belt 25. The intermediate transfer belt 25 is pressed against the photoconductors 4K, 4Y, 4M, and 4C by primary transfer rollers 26K, 26Y, 26M, and 26C arranged inside of a belt loop near the primary transfer nip for K, Y, M, and C. A primary transfer bias is applied to the respective primary transfer rollers 26K, 26Y, 26M, and 26C by a power source (not shown). Accordingly, a primary transfer electric field that causes the toner image on the photoconductors 4K, 4Y, 4M, and 4C to electrostatically move toward the intermediate transfer belt 25 is formed. The toner images are sequentially superposed at the respective primary transfer nips and primarily transferred onto the surface of the intermediate transfer belt 25, which sequentially passes through the primary transfer nips for K, Y, M, and C with an endless movement thereof in the clockwise direction in FIG. 3. A four-color superposed toner image (hereinafter, "four-color toner image") is formed on the surface of the intermediate transfer belt 25 due to the superposed primary transfer.

The paper conveying unit 28 in which an endless paper conveying belt 29 is spanned between a drive roller 30 and a secondary transfer roller 31 to endlessly move is provided below the transfer unit 24 in FIG. 2. The intermediate transfer belt 25 and the paper conveying belt 29 are put between the secondary transfer roller 31 of the paper conveying unit 28 and a lower tension roller 27 of the transfer unit 24. Accordingly, a secondary transfer nip is formed, at which the surface of the intermediate transfer belt 25 and the surface of the paper conveying belt 29 abut against each other. A secondary transfer bias is applied to the secondary transfer roller 31 by a power source (not shown). On the other hand, the lower tension roller 27 of the transfer unit 24 is grounded. Accordingly, a secondary transfer electric field is formed in the secondary transfer nip.

The registration rollers 33 are arranged on the right side of the secondary transfer nip in FIG. 2 to deliver the recording paper put between the rollers to the secondary transfer nip at timing capable of synchronize the recording paper with the four-color toner image on the intermediate transfer belt. The four-color toner image on the intermediate transfer belt 25 is secondarily transferred in a batch onto the recording paper in the secondary transfer nip due to an influence of the secondary transfer electric field or a nip pressure, to form the full-color image, mixed with white of the recording paper. The recording paper having passed through the secondary transfer nip is separated from the intermediate transfer belt 25, and carried to the fixing unit 60 with the endless movement of the paper conveying belt 29, while being held on the surface thereof.

A transfer residual toner, which has not been transferred to the recording paper at the secondary transfer nip, is adhered on the surface of the intermediate transfer belt 25 having passed through the secondary transfer nip. The transfer residual toner is scraped and removed by a belt cleaning unit 32 abutting against the intermediate transfer belt 25.

After the full color image is fixed on the recording paper carried to the fixing unit 60 by pressurizing or heating in the fixing unit 60, the recording paper is delivered from the fixing unit 60. The recording paper is then ejected out of the apparatus after passing through the nip formed by the curl-removing roller group 34 shown in FIG. 1 and the nip formed by the paper-ejection rollers 35.

The switch-back unit 36 is arranged below the paper conveying unit 28 and the fixing unit 60. Accordingly, the path of the recording paper subjected to an image fixing process for one side thereof is switched to a recording-paper reversing unit side by a switching claw, so that the recording paper is reversed by the recording paper reversing unit to go into the secondary transfer nip again. After the secondary transfer processing and the fixing processing of the image are performed on the other side of the recording paper, the recording paper is ejected onto an ejection tray.

The scanner 150 fixed on the printer unit 1 includes a fixed read unit 151 and a movable read unit 152 as a reader for reading the image of an original MS. The fixed read unit 151 including an image read sensor such as a light source, a reflecting mirror, and a charge-coupled device (CCD) is arranged immediately below a first contact glass (not shown) fixed on an upper wall of a casing of the scanner 150 to contact with the original MS. When the original MS carried by the ADF 51 passes on the first contact glass, the fixed read unit 151 sequentially reflects light emitted from the light source on the surface of the original and receives the light by the image read sensor via a plurality of reflecting mirrors. Accordingly, the original MS is scanned without moving an optical system including the light source and the reflecting mirror.

On the other hand, the movable read unit 152 is arranged immediately below a second contact glass (not shown) fixed on the upper wall of the casing of the scanner 150 to come in contact with the original MS and on the right side of the fixed read unit 151 in FIG. 1. The movable read unit 152 can move the optical system including the light source and the reflecting mirror in a horizontal direction in FIG. 1. The movable read unit 152 reflects the light emitted from the light source on the original (not shown) placed on the second contact glass in a process of moving the optical system from left to right in FIG. 1, and receives the light by an image read sensor 153 fixed on the scanner body via the reflecting mirrors. Accordingly, the original is scanned while moving the optical system.

A conveying path for conveying the recording paper P, which is a sheet-like recording member is formed in the printer unit 1. A toner-image forming unit that forms the toner image on the recording paper P, which is the recording member carried in the conveying path, is formed by a combination of the optical writing unit 2, the process units 3K, 3Y, 3M, and 3C, and the transfer unit 24 in the printer unit 1. The paper feed path 37 is a part of the conveying path, and is a pre-recording channel for conveying the recording paper P received from the paper feeding unit 40 up to immediately before the secondary transfer nip, which is a toner-image forming position with respect to the recording paper P. The path after the secondary transfer nip is a post-recording channel for conveying the recording paper P after the toner image is formed. The post-recording channel is a channel sequentially tracing the secondary transfer nip, the upper tensioned surface of the paper conveying belt 29, inside the fixing unit 60, the nip formed by the curl-removing roller group 34, and the nip formed by the paper-ejection rollers 35.

Figure 4:
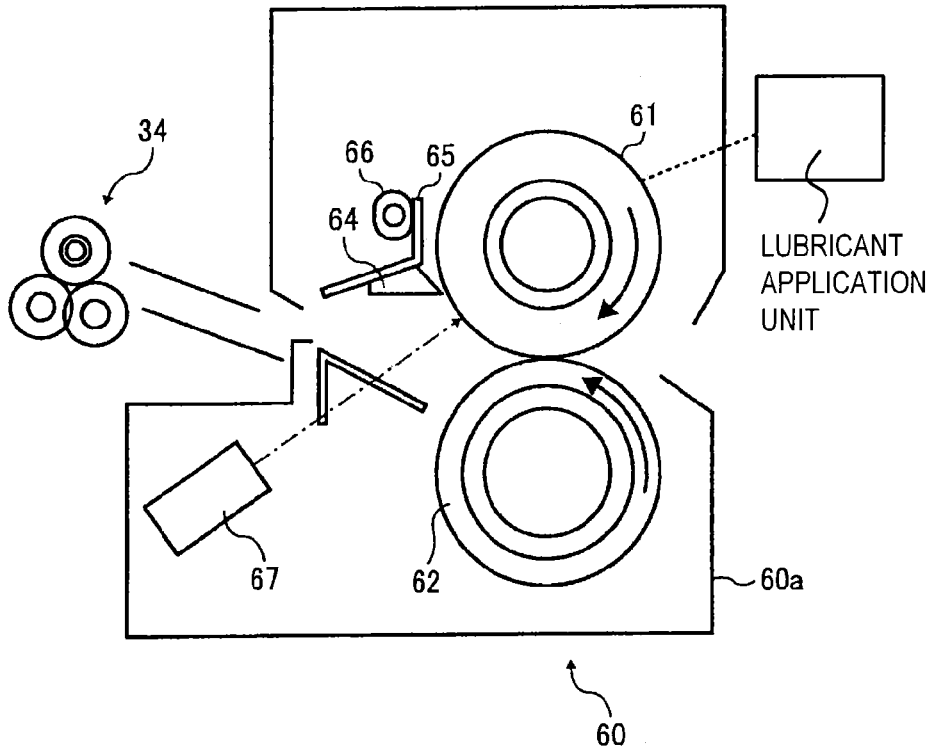
FIG. 4 is an enlarged configuration diagram of a fixing unit and a curl-removing roller group in the printer unit.

FIG. 4 is an enlarged configuration diagram of the fixing unit 60 and the curl-removing roller group 34. In FIG. 4, the fixing unit 60 includes, in a casing 60*a*, a fixing roller 61 that includes a heating source such as a halogen lamp (not shown) therein, a pressure roller 62, a separation claw 64, a claw holder 65, an eccentric cam 66, and a laser displacement sensor 67. The fixing roller 61 is rotated by a driving means (not shown) in the clockwise direction in FIG. 4. The pressure roller 62 arranged below the fixing roller 61 in FIG. 4 abuts against the fixing roller 61 with a predetermined pressure to form a fixing nip, and is rotated by a driving means (not shown) in a counterclockwise direction in FIG. 4. The fixing roller 61 and the pressure roller 62 form a pair of conveying members that conveys the recording paper by holding it in the fixing nip, which is a conveying nip formed by bringing the endlessly moving surfaces thereof to abut against each other.

The recording paper P transferred from the paper conveying unit (28 in FIG. 2) to the fixing unit 60 is heated or pressurized by the fixing roller 61 at the time of passing through the fixing nip, and the toner image of the surface thereof is fixed onto the recording paper P. The recording paper P is delivered out of the fixing unit 60.

A plurality of pairs of conveying members are arranged in the post-recording channel. For example, a combination of the intermediate transfer belt 25 and the paper conveying belt 29 is one example thereof. Further, a combination of the fixing roller 61 and the pressure roller 62 that forms the fixing nip, the curl-removing roller group 34, and the nip formed by the paper-ejection rollers (35 in FIG. 2) are the examples of the conveying members. Among these, particularly in the fixing nip formed by the combination of the fixing roller 61 and the pressure roller 62, winding of the recording paper P easily occurs. It is because, in the fixing unit 60, the toner on the surface of the recording paper P is softened by heating to increase the viscosity thereof.

In the fixing unit 60, the separation claw 64 held by the claw holder 65 forcibly peels the recording paper P wound around the fixing roller 61 from the surface of the fixing roller 61 by bringing the end of the separation claw 64 to abut against the fixing roller 61. The eccentric cam 66 rotated by the driving means (not shown) is arranged on the left side of the claw holder 65 in FIG. 4. The claw holder 65 is supported slidably and movably in the horizontal direction in FIG. 4 by a support body (not shown). A coil spring (not shown) abuts against the claw holder 65. Accordingly, the claw holder 65 is biased from right to left in FIG. 4 to abut against the eccentric cam 66. When the eccentric cam 66 stops at an angle of rotation for bringing a short diameter side of the eccentric cam 66 into contact with the claw holder 65, the claw holder 65 is retracted to a position where the end of the separation claw 64 is separated from the fixing roller 61 as shown in FIG. 4. In this case, peeling of the recording paper P from the fixing roller 61 by the separation claw 64 is not performed. On the other hand, when the eccentric cam 66 rotates up to an angle at which the long diameter side of the eccentric cam 66 is brought into contact with the claw holder 65, the claw holder 65 is pushed from left to right in FIG. 4, and the end of the separating claw 64 abuts against the fixing roller 61. Accordingly, the separation claw 64 peels the recording paper P from the fixing roller 61.

The laser displacement sensor 67 as a distance detecting unit is arranged on the left side of the pressure roller 62 in FIG. 4. The laser displacement sensor 67 emits laser beams toward the fixing roller 61 as shown in FIG. 4. The laser beams reach a vicinity area of the outlet of the fixing nip on the circumference of the fixing roller 61. When the recording paper (not shown) fed out of the fixing nip crosses an optical path of the laser beams, the laser beams are reflected by a rear face of the recording paper and returns to the laser displacement sensor 67. The laser displacement sensor 67 outputs a voltage corresponding to a distance between the recording paper and a laser emitting surface thereof based on the reflected light. That is, the laser displacement sensor 67 functions as the distance detecting unit that detects the distance between the tip of the recording paper immediately after coming out from the fixing nip and the laser displacement sensor 67 itself, of the whole area of the conveying path. A unit different from the laser displacement sensor, such as a distance measuring sensor having an LED light source installed therein can be used as the distance detecting unit.

Figure 27:
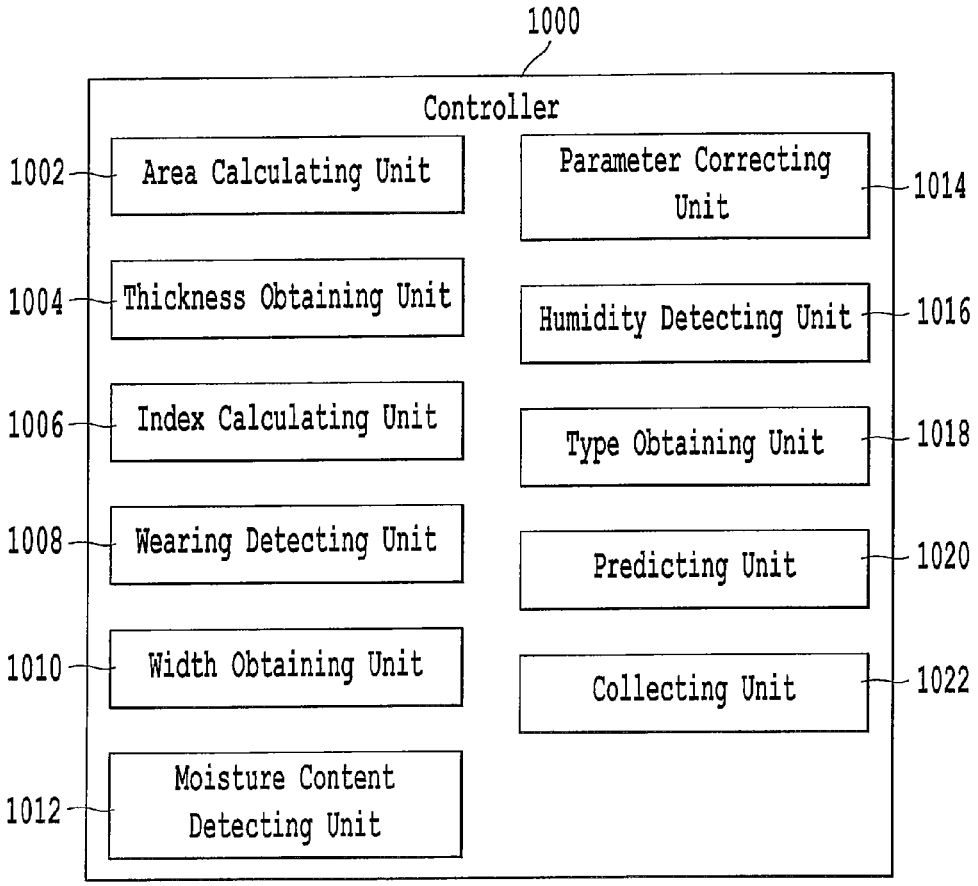
FIG. 27 shows the elements of the controller.

The output voltage from the laser displacement sensor 67 is converted from analog data to digital data by an A/D converter (not shown) and transmitted to a controller 1000. The controller performs overall control of the printer unit (1 in FIG. 1), and includes a central processing unit (CPU) as an arithmetic unit, a random access memory (RAM) as an information storage unit, a read only memory (ROM) as an information storage unit, a hard disk drive (HDD) as an information storage unit, and the like. The controller executes various processes based on a program or the like stored in these information storage units to provide (FIG. 27): an area calculation unit 1002; a thickness obtaining unit 1004; an index calculating unit 1006; a wearing determining unit 1008; a width obtaining unit 1010; a moisture content detecting unit 1012; a parameter correcting unit 1014; a humidity detecting unit 1016; a type obtaining unit 1018; a predicting unit 1020; and a collecting unit 1022. Various devices and sensors are connected to the controller, and the laser displacement sensor 67 is connected to the controller via the A/D converter. The controller stores the digital data transmitted from the A/D converter in a data storage unit such as a hard disk (not shown) as required.

The surface of the fixing roller 61 is black. When the recording paper is not crossing the optical path of the laser beams emitted from the laser displacement sensor 67, the laser beams reach the fixing roller 61; however, when the fixing roller 61 is in an initial state, the laser beams are absorbed by the fixing roller 61. Accordingly, because the laser displacement sensor 67 does not detect the laser reflected light, a value of the output voltage from the sensor becomes a value corresponding to nondetection. However, when the fixing roller 61 gradually wears, an apparent reflectance on the surface increases. Therefore, a small amount of laser beams is reflected on the surface of the fixing roller 61 to return to the laser displacement sensor 67. In this case, the laser displacement sensor 67 outputs a voltage corresponding to the distance between the surface of the laser emitting surface thereof and the surface of the fixing roller 61.

As explained above, in the copying machine, the registration rollers (33 in FIG. 2) feed out the recording paper toward the secondary transfer nip. The time required for the tip of the recording paper to reach a detection position by the laser displacement sensor 67 from a feed start point via the secondary transfer nip, the upper tensioned surface of the paper conveying belt, and the fixing nip is about 1.2 seconds. Further, the time required for a rear end of the recording paper to pass through the detection point by the laser displacement sensor 67 from the feed start position from the registration rollers is about 1.8 seconds. Accordingly, the recording paper crosses the detection position by the laser displacement sensor 67 between after 1.2 seconds to after 1.8 seconds. The timing may have a slight error and to be safe, it is considered that the recording paper passes through the detection position without fail in a range of from after 1.15 seconds to after 1.85 seconds.

As the pressure roller 62, the one in which the surface of the roller is made of a pure metal is used. On the other hand, as the fixing roller 61, the one in which the surface of the roller is made of an elastic material such as rubber, for improving adherence with the recording paper, and therefore the adhesion with the recording paper is higher than that of the pressure roller 62. Even when the both rollers wear, magnitude correlation of the adhesion does not change. Accordingly, if winding of the recording paper after passing through the fixing nip occurs, the recording paper is always wound around the fixing roller 61.

A configuration of a copying machine according to a reference mode, which is a reference in understanding the copying machine according to the first embodiment, is explained next. The copying machine according to the reference mode has the same basic configuration as that of the copying machine according to the first embodiment. IN the reference mode, like reference numerals designated to respective units refer to like units in the copying machine according to the first embodiment.

The copying machine according to the reference mode stores formulae of first to tenth principal components based on a multiple analytical approach relating to the behavior of the recording paper at the outlet of the fixing nip, in a data storage unit such as a hard disk and a nonvolatile memory. A predetermined multiple regression equation is also stored.

These equations are established according to a method explained below. That is, a new fixing roller is set in the fixing unit 60 as the fixing roller 61. A test image is respectively printed on 500 [1000 sheets] recording paper (A4 size) in a state with the separation claw 64 being separated from the fixing roller 61. During a period until 500 [1000 sheets] printing is complete, an output voltage value from the laser displacement sensor 67 from after 1.15 seconds to after 1.18 seconds is first obtained with every 0.001 second interval for the first to 100th prints and stored in the data storage unit. The number of data obtained with the 0.001 second interval from after 1.15 seconds to after 1.18 seconds is 701. For the 101st prints onwards, the 701 pieces of data, which are time-series detection data by the laser displacement sensor 67, are obtained for every predetermined number of prints (for example, for every 100 prints) and stored in the data storage unit.

As the recording paper, a plurality of types of paper having a different thickness, such as thin paper (45 kg paper), medium thickness paper (70 kg paper), and thick paper (110 kg paper) is used. As the test image, a plurality of types of images having a different image area, such as a full-page halftone (provided that a margin area at an upper end and a lower end of the paper is excluded), "full-page halftone+solid at the tip end" and the like is used in addition to "no image" (simple plain paper). 500 [1000 sheets] printing is then executed for each combination that can be obtained with the types of the recording paper and the types of the test images. In each printing up to 500 [1000 sheets] sheets, the 701 pieces of data are stored as described above. For example, if the types of the recording paper are five types, and the types of the test images are five types, 25 combinations can be obtained as the combination of the recording paper and the test image (paper thickness five types×five image types). A new fixing roller 61 is set to execute 500 [1000 sheets] printing for each of 25 combinations. In each of 500 [1000 sheets] printing, the output voltage value from the laser displacement sensor 67 from after 1.15 seconds to after 1.18 seconds is obtained with every 0.001 second interval for the first to 100th prints and stored in the data storage unit. For the 101st prints onwards, the 701 pieces of data, which are time-series detection data by the laser displacement sensor 67, are obtained for every predetermined number of prints and stored in the data storage unit. In 500 [1000 sheets] printing, when the number of accumulated prints increases considerably, the recording paper can be wound around the fixing roller 61 to cause a jam. In this case, the jammed paper is removed to continue printing.

When 500 [1000 sheets] printing is complete for all the combinations (paper thickness+test image types: hereinafter, "paper thickness and image combination"), principal component analysis is performed by using the time-series detection data of the first to 100th prints for each of the "paper thickness and image combination". As well known, the principal component analysis refers to a method of representing values of many variables by one or a few comprehensive indexes (principal components) without a loss of information as much as possible. That is, the 701 pieces of data in the time series detection data is represented by one or a small amount of data by the principal component analysis. Explanations of a specific method of the principal component analysis will be omitted; however, if a formula of the first principal component obtained by the principal component analysis is used, the 701 pieces of data can be represented by one data. Normally, however, the entire data waveform cannot be sufficiently represented only by the formula of the first principal component. To reflect a waveform portion that cannot be captured by the formula of the first principal component, therefore, a formula of the second principal component is obtained. Further, when the entire waveform cannot be sufficiently represented only by the formulae of the first and second principal components, the third, fourth and onward principal components are sequentially obtained, and the formulae thereof are also used. According to experiments performed by the present inventors, it is found that about 84% of the entire waveform can be represented by the formulae of the first to tenth principal components in all the combinations of the paper thickness and the test images. Therefore, the data storage unit stores the formulae of the first to tenth principal components for each "paper thickness and image combination", and these are designated as standard data representing the waveform of the time-series detection data in conditioning using the fixing roller 61 with no wearing.

Thus, when the formulae of the first to tenth principal components as the standard data are obtained for each "paper thickness and image combination", determination of a winding index value, calculation of a principal component score, and calculation of the multiple regression equation are performed for each "paper thickness and image combination".

Specifically, the time-series detection data obtained in each number of prints is wave-formed in a graph, respectively, for one "paper thickness and image combination". That is, the time-series detection data for each of the first print, the second print, . . . , the 100th print, and a predetermined number of prints is waveformed individually in a graph. Windability of the recording paper around the fixing roller is then respectively evaluated, while visually observing respective waveforms, to determine the winding index value corresponding to the windability. For example, a range of the winding index value is set such that as a numerical value of the winding index value increases, it indicates a state in which the recording paper tends to wind around the fixing roller 61, and when the winding index value exceeds 55, winding starts to occur, to determine to which winding index value each waveform corresponds.

When the winding index value is determined, the principal component score is respectively calculated for the time-series detection data obtained with each number of prints in the "paper thickness and image combination". The first principal component score to the tenth principal component score obtained by substituting the time-series detection data for each of the first print, the second print, . . . , the 100th print, and a predetermined number of prints into the formulae of the first to tenth principal components are calculated. The multiple regression equation of "winding index value (estimated value)=constant A+a1×first principal component score+a2× second principal component score+ . . . +a10×tenth principal component score" is obtained by a method of least squares and stored in the data storage unit. According to the method of least squares, the constant A and respective coefficients (a1 to a10) are determined so that the sum of squares of the estimated value calculated by designating these as unknown quantity and a true value becomes the smallest.

The formulae of the first to tenth principal components and the multiple regression equation are obtained respectively for all the "paper thickness and image combination" in the above manner, and stored in the data storage unit. In the case of the same machine type, because the formulae of the principal components and the multiple regression equation become substantially the same among individual products, the formulae of the principal components and the multiple regression equation need not be established individually for each product.

Processing described below is performed by the controller 1000 every time the user performs printing. That is, thickness information of the recording paper to be used for printing is obtained by a thickness-information obtaining unit. As the thickness-information obtaining unit, a combination of a unit that displays a message urging the user to input the thickness information of the recording paper on a display unit and an input unit such as a key button that accepts an input of the thickness information by the user in response to the message can be used. A thickness detector that detects the thickness of the recording paper carried in the conveying path can be also used. As the thickness detector, the one in which one of the conveying rollers such as the registration rollers is displaceably biased against the other roller by a biasing unit such as a spring, and a detection result of a displacement of the one roller when the recording paper is inserted into the nip of the conveying rollers by the distance sensor or the like is designated as the thickness can be used.

Almost at the same time when the thickness information is obtained, an image area of the toner image to be printed is calculated based on the image information. The controller specifies to which of the "paper thickness and image combination" stored in the data storage unit the thickness information and the image area approximate, which is then stored as an "approximation combination". The 701 pieces of data are obtained with the progress of the printing operation, and the first to tenth principal component scores are calculated by substituting the time-series detection data into the formulae of the first to tenth principal components in the "approximation combination" stored beforehand in the data storage unit. After the winding index value (estimated value) is calculated by substituting these principal component scores into the multiple regression equation, the calculation result and a predetermined notified threshold are compared. In this comparison, when the calculation result exceeds the notified threshold, it is regarded that the wearing of the fixing roller 61 nearly reaches the end of service life, and a message urging the user to replace the fixing roller 61 is displayed on the display unit.

The notified threshold is set in the following manner. That is, for example, it is assumed that when the winding index value becomes "55", winding of the recording paper around the fixing roller 61 starts to occur. In this case, at a point in time when the winding index value takes a slightly smaller value than "55", for example "50", winding has not occurred yet, but will start to occur soon afterwards. Therefore, if the above notified threshold is set to "50", the user is urged to replace the fixing roller 61 at an appropriate timing. Accordingly, "50" is set as the notified threshold.

A characteristic configuration of the copying machine according to the first embodiment is explained next. In the copying machine according to the first embodiment, the method of obtaining the winding index value by the user is the same as that in the reference mode, unless otherwise specified.

Even with the recording paper having the same thickness, the recording paper having a wider width demonstrates a stronger stiffness. Therefore, the thickness of the recording paper and the stiffness do not always exhibit excellent correlation. Nevertheless, the principal component analysis is performed, regarding the thickness of the recording paper as the stiffness in the copying machine according to the reference mode. Accordingly, a slight discrepancy can be generated between the winding index value and the actual wearing of the fixing roller 61. In the copying machine according to the first embodiment, therefore, the controller as the index-value calculating unit is configured to calculate the winding index value based on the width of the recording paper (the size in a direction orthogonal to a feeding direction) in addition to the time-series detection data indicating the behavior of the recording paper and the thickness of the recording paper. Specifically, the formulae of the first to tenth principal components and the multiple regression equation are established based on an experiment result, respectively, for prints having a different combination of the thickness of the recording paper, the image area of the toner image, and the width of the recording paper (hereinafter, "paper thickness, image, and paper width combination") from each other, which are then stored in the data storage unit. As the thickness-information obtaining unit, the same one as that in the reference mode is provided. Further, a width information detector that obtains width information of the recording paper to be used at the time of printing is provided. As the width information detector, a combination of a unit that displays a message urging the user to input the width information of the recording paper on the display unit and an input unit such as a key button that accepts an input of the width information by the user in response to the message can be used. A width detector that detects the width of the recording paper can be also used. As the width detector, a unit that detects the width of the recording paper stored in the paper feed cassette 42 as a recording member storing unit, based on a position of a paper-end retaining plate movably provided in the cassette can be mentioned. Further, a unit in which a plurality of paper detection sensors including a reflecting photosensor that detects the recording paper carried in the conveying path is arranged along a width direction of the paper, and the paper width is detected based on presence of detection of the recording paper by these paper detection sensors can be used.

Processing described below is performed by the controller every time the user performs printing. That is, thickness information and width information of the recording paper to be used for printing is obtained by the thickness-information obtaining unit and a width-information obtaining unit. Almost at the same time when these pieces of information are obtained, an image area of the toner image to be printed is calculated based on the image information. The controller specifies to which of the "paper thickness, image, and paper width combination" stored in the data storage unit the combination of the thickness information, the width information, and the image area approximates most, which is then stored as an "approximation combination". The controller then obtains the 701 pieces of data with the progress of the printing operation, and calculates the first to tenth principal component scores by substituting the time-series detection data into the formulae of the first to tenth principal components in the "approximation combination" stored beforehand in the data storage unit. After calculating the winding index value by substituting these principal component scores into the multiple regression equation, the controller compares the calculation result with a predetermined notified threshold. In this comparison, when the calculation result exceeds the notified threshold, the controller regards that the wearing of the fixing roller 61 nearly reaches the end of service life, and displays a message urging replacement of the fixing roller 61 on the display unit.

A numerical value that most accurately indicates the stiffness of the sheet member is the bending stiffness, which is obtained by multiplying a Young's modulus E of the sheet member by a geometrical moment of inertia I (bending stiffness=EI [$Nm^2$]). When the width of the sheet member is expressed by b, and the thickness is expressed by t, the geometrical moment of inertia I is obtained by an equation of [$I=bt^3/12$]. That is, the bending stiffness can be obtained by [$Ebt^3/12$]. As seen from this equation, the bending stiffness is proportional to a product of the width of the sheet member and a cube of the thickness. Accordingly, the copying machine in which the thickness and the width are reflected can determine the winding index value more accurately than the copying machine according to the reference mode in which only the thickness is reflected.

As the parameter indicating the stiffness of the sheet, Clark stiffness is widely used. However, application of the Clark stiffness to the copying machine according to the present invention is not preferable due to a reason described below.

Figure 5:
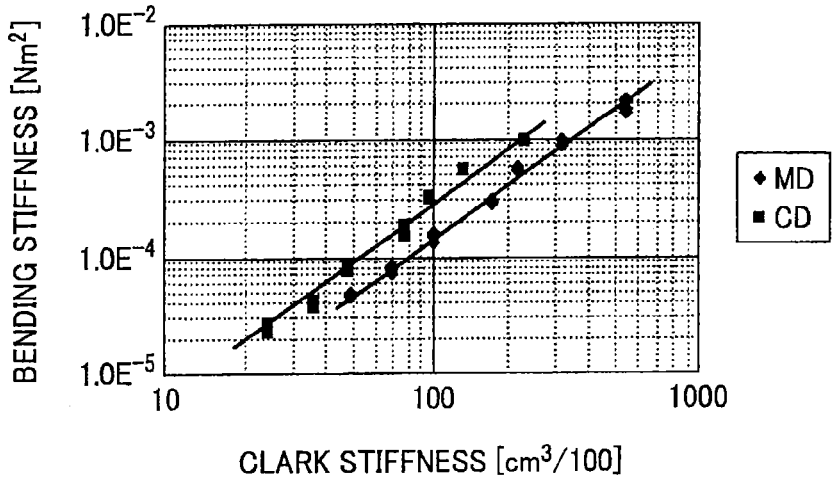
FIG. 5 is a graph of a relationship between bending stiffness and Clark stiffness.

FIG. 5 is a graph of a relationship between bending stiffness and Clark stiffness, where the Clark stiffness exhibits a different graph showing the correlation with the bending stiffness according to posture of the sheet. Specifically, a straight line extending along diamond-shaped plotted points in FIG. 5 indicates a relationship between the bending stiffness and the Clark stiffness when the sheet is curved along a machine direction (MD), which is a direction in which paper fibers extend. Further, a straight line extending along square-shaped plotted points in FIG. 5 indicates the relationship between the bending stiffness and the Clark stiffness when the sheet is curved along a direction orthogonal to the machine direction (CD). Thus, the Clark stiffness exhibits a different graph showing the correlation with the bending stiffness according to the posture of the sheet. Because it is difficult for the user to specify the machine direction of the commercially available sheet or it is difficult to detect it by a sensor, determination of the Clark stiffness is very difficult. Therefore, it is not preferable to use the Clark stiffness in the copying machine according to the present invention. In the present invention, therefore, the bending stiffness is used as an index expressing the stiffness of the sheet.

According to the configuration described above, because the width of the recording paper is used in addition to the thickness of the paper as the parameters indicating the stiffness of the recording paper, the winding index value can be calculated more accurately than in the copying machine according to the reference mode using only the thickness of the recording paper. Accordingly, the wearing of the fixing roller 61 can be determined more accurately.

In the copying machine, a winding reducing unit for reducing winding of the recording paper around the fixing roller 61 worn to a certain degree is provided. Specifically, as the winding reducing unit, a lubricant application unit capable of applying a lubricant to the fixing roller 61 according to need is provided. An application member capable of applying the lubricant to the fixing roller 61 is provided so that it can approach or be separated from the fixing roller 61, and by bringing the application member to abut against the fixing roller 61 according to need, the lubricant can be applied to the fixing roller 61.

The controller of the copying machine compares the winding index value with a preliminary threshold, instead of comparing the winding index value with the notified threshold until the winding index value increases to some extent. Because the preliminary threshold has a smaller value than the notified threshold, the winding index value first exceeds the preliminary threshold prior to the notified threshold.

Figure 6:
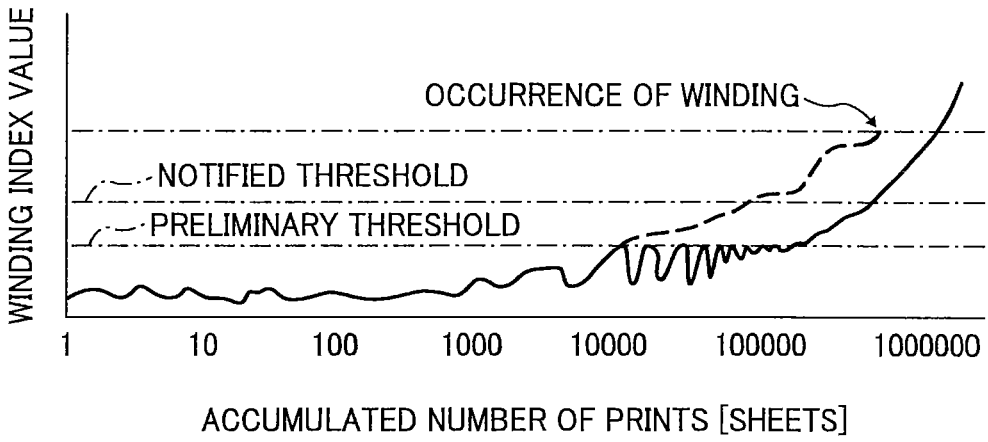
FIG. 6 is a graph of a relationship between the number of accumulated prints and a winding index value in the copying machine.

FIG. 6 is a graph of a relationship between the number of accumulated prints and the winding index value in the copying machine. With an increase of the number of accumulated prints, the winding index value gradually increases, and reaches the preliminary threshold. At this point in time, the application member separated from the fixing roller 61 is brought to abut against the fixing roller 61 for a predetermined time, to apply the lubricant to the fixing roller 61. Because the windability of the recording paper around the fixing roller 61 temporarily decreases, the winding index value decreases. However, with printing carried out afterwards, the winding index value increases again, and reaches the preliminary threshold again. The application of the lubricant is then performed again. Due to the repetition of this process, the graph of the winding index value fluctuates up and down. However, the position of waviness is being raised as a whole. When the waviness of the graph occurs at a higher position than the preliminary threshold, application of the lubricant is performed frequently, and the winding index value soon reaches the notified threshold even if application of the lubricant is performed. At this point in time, the controller notifies a message urging the user to replace the fixing roller 61, and brings the separation claw 64 to abut against the fixing roller 61. A curve shown by dotted line in FIG. 6 indicates transition of the winding index value when application of the lubricant is not performed.

In such a configuration, replacement timing of the fixing roller 61 can be delayed by applying the lubricant to the fixing roller 61 according to need. Further, only when the fixing roller 61 is worn up to just before the end of the service life, the separation claw 64 is brought to abut against the fixing roller 61, thereby enabling to avoid acceleration of wearing the fixing roller 61 due to continuous abutment from an initial stage.

When the message urging the user to replace the fixing roller 61 is notified based on a fact that the winding index value has exceeded the notified threshold, replacement of the fixing roller 61 is not always performed promptly. It is considered that replacement is performed after a certain period of time, due to requesting the dispatch of a service engineer or the like. Until the fixing roller 61 is replaced, the fixing roller 61 nearly reaching the end of the service life is continuously used. However, if printing is performed in a large amount in this period, winding of the recording paper can occur before the replacement.

In the copying machine, therefore, the controller is configured such that it predicts whether winding of the recording paper will occur in each print, during a period since notification of the message urging the replacement of the fixing roller 61 until it is replaced. Specifically, as described above, the data storage unit stores the formulae of the principal components and the multiple regression equation, respectively, for each of the "paper thickness, image, and paper width combination". In addition to that, the data storage unit also stores the latest winding index value in the actual printing operation as a "winding index value history". For example, when printing is performed for a certain "paper thickness, image, and paper width combination", designating it as the "approximation combination", the winding index value stored as the "winding index value history" for the "paper thickness, image, and paper width combination" is updated as the winding index value in the printing.

When the user issues a print command, after the "approximation combination" is specified for a combination of the thickness information, the width information, and the image area, the "winding index value history" corresponding to the "approximation combination" is specified. The "winding index value history" is then compared with a predetermined winding occurrence threshold (larger than the threshold mentioned above), and when the "winding index value history" does not exceed the winding occurrence threshold, it is predicted that winding does not occur. On the other hand, when the "winding index value history" exceeds the winding occurrence threshold, it is predicted that winding will occur. In this case, the printing operation (image forming operation) is suspended, and a message indicating that the printing operation has been suspended forcibly because there is high possibility of winding occurrence is notified to the user.

As the thickness-information obtaining unit and the width-information obtaining unit, when the one that obtains the thickness information and the width information by an input operation of the user is used, it can be predicted whether winding will occur before the recording paper is fed out of the paper feed cassette. Therefore, when there is high possibility that winding can occur, the printing operation is suspended before starting development of the toner image, thereby enabling to avoid wasteful toner consumption due to winding. Even when the one that actually detects the thickness and the width of the recording paper in the conveying path is used as the thickness-information obtaining unit and the width-information obtaining unit, respective detectors can be arranged so that both the thickness and the width can be detected when the recording paper reaches the registration rollers 33 at latest. At this point in time, because the development of the toner image is not started, or even if the development has been started, the operation is still during the development. Therefore, if the printing operation is suspended at this point in time, wasteful toner consumption can be reduced.

The winding index value can be also determined by a Mahalanobis Taguchi system (MTS) method, instead of performing the principal component analysis. The MTS method is explained in detail in "Technical Development in MT System (by Genichi Taguchi, Publication Committee Chairman, published by Japan Standards Association)". Therefore, detailed explanations thereof will be omitted, and only an outline thereof is as described below. That is, at first, group data including a plurality of pieces of information is obtained from a subject to be detected in a normal state or the same specification subject having the same specification as that of the subject to be detected. For example, the group data includes respective detection results by sensors A, B, and C, and control parameters X, Y, and Z. A large number of group data is collected, while test-driving the subject to be detected in the normal state, to build an inverse matrix, which becomes standard data. Thereafter, a Mahalanobis distance indicating which relative position the group data has in a multidimensional space by the standard data built beforehand is determined, and normality of the subject to be detected is measured based on the result thereof.

As the group data, data including at least the 701 pieces of distance detection data in the time-series detection data, the thickness information, the width information, and the image area is obtained in large numbers under a condition of a new fixing roller, and the inverse matrices thereof are stored in the data storage unit as the standard data. When the user performs printing, the thickness information, the width information, and the image area are obtained, to determine the Mahalanobis distance based on the obtained results and the inverse matrices. The fixing roller 61 needs only to be replaced based on a fact that the Mahalanobis distance has exceeded a predetermined threshold.

The winding index value can be determined more accurately, if the data including the following data in addition to the 701 pieces of distance detection data, the thickness information, and the width information is used as the group data; that is, the size of the recording paper, development condition (development density), transfer condition (transfer bias value), fusing condition (temperature and pressure), and the like.

A copying machine according to examples in which other characteristic configurations are added to the copying machine in the first embodiment are explained next.

In the copying machine in the example, the respective formulae of the first to tenth principal components and the multiple regression equation are established based on experiment results, for the prints of a different combination of the image area of the toner image and the parameter indicating the stiffness of the recording paper (hereinafter, "image and parameter combination"), and the respective results are stored in the data storage unit. As the parameter indicating the stiffness of the recording paper, the one in which the bending stiffness is divided for each certain numerical range and indicated as one numerical value, respectively, can be exemplified. It is because in the case of the recording paper having the same thickness and the same width, even if the Young's modulus is different, the bending stiffness falls within a certain numerical range. If a data table associating the combination of the thickness and the width with the parameter obtained by digitizing the numerical range of the bending stiffness is stored in the data storage unit, the parameter corresponding to the thickness information and the width information can be specified from the data table. Further, "$bt^3$" in the above equation, "bending stiffness=$Ebt^3/12$", can be set as the parameter indicating the stiffness. The data storage unit stores the formulae of the first to tenth principal components and the multiple regression equation for the prints of the different combination of the image area of the toner image and any one of the parameters.

In the copying machine, a moisture sensor as a moisture-content detecting unit that detects a moisture content of the recording paper is provided in the conveying path of the recording paper. The controller performs processing described below every time when the user performs printing. That is, the controller obtains the parameter based on the thickness information and the width information. The controller then corrects the obtained parameter based on the detection result of the moisture sensor.

Figure 7:
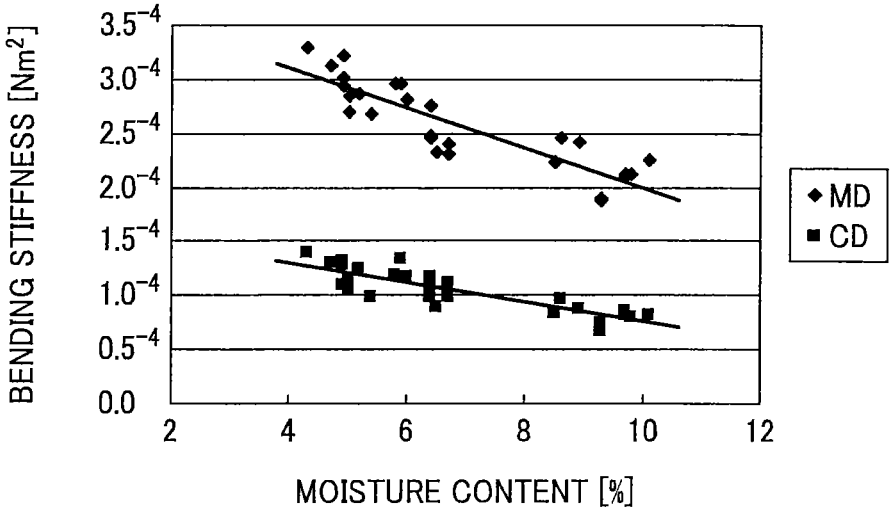
FIG. 7 is a graph of a relationship between the bending stiffness and moisture content of recording paper.

FIG. 7 is a graph of a relationship between the bending stiffness and the moisture content of the recording paper. The bending stiffness of the recording paper changes corresponding to the moisture content of the recording paper both in the machine direction (MD) and the direction orthogonal to the machine direction (CD). The moisture content of the recording paper also changes corresponding to the humidity and the temperature. If the bending stiffness of the recording paper is detected and the winding index value is calculated based on the detection result as in a copying machine according to a second embodiment of the present invention described later, a change of the bending stiffness with the change of the moisture content does not affect the calculation accuracy of the winding index value. However, if the parameter is used as in this copying machine, the change of the bending stiffness with the change of the moisture content affects the calculation accuracy of the winding index value. The graph in FIG. 7 indicates a characteristic of the recording paper of a certain specific type, where the recording paper has the same characteristic even when the type of the recording paper is different. Accordingly, a correction equation capable of correcting the parameter based on the moisture content can be established, regardless of the type of the recording paper. For example, in calculation of the parameter, the correction equation is such that after a value under the condition of moisture content 6[%] is calculated, and when the detection result of the moisture content is higher than 6[%], as the value becomes higher, the calculation result (parameter) is corrected to a smaller value; on the other hand, when the calculation result is lower than 6[%], as the value becomes lower, the calculation result is corrected to a larger value.

The data storage unit also stores the correction equation. The controller corrects the calculated parameter based on the detection result of the moisture content and the correction equation. Thereafter, the controller calculates the image area of the toner image to be printed based on the image information. The controller specifies to which of the "image and parameter combination" stored in the data storage unit the combination of the corrected parameter and the image area approximates, which is then stored as an "approximation combination". The controller then obtains the 701 data with the progress of the printing operation, and substitutes these time-series detection data into the formulae of the first to tenth principal components in the "approximation combination" stored beforehand in the data storage unit, to calculate the first to tenth principal component scores. After calculating the winding index value by substituting these principal component scores in the multiple regression equation, the controller compares the calculation result with the preliminary threshold or the notified threshold.

In such a configuration, an inappropriate parameter obtained due to a difference of the moisture content of the recording paper is reduced by correction of the parameter, to thereby obtain the winding index value more accurately. Accordingly, the wearing of the fixing roller 61 can be determined highly accurately. As the moisture sensor, the one that detects the moisture (moisture content) of the recording paper in the paper feed cassette can be used.

A modification of the copying machine according to the example is explained next. In the apparatus according to a modification, a humidity sensor as a humidity detecting unit and a type-information obtaining unit that obtains type information of the recording paper are provided instead of the moisture sensor. The parameter is corrected based on the detection result of the humidity and the obtained result of the type information.

Figure 8:
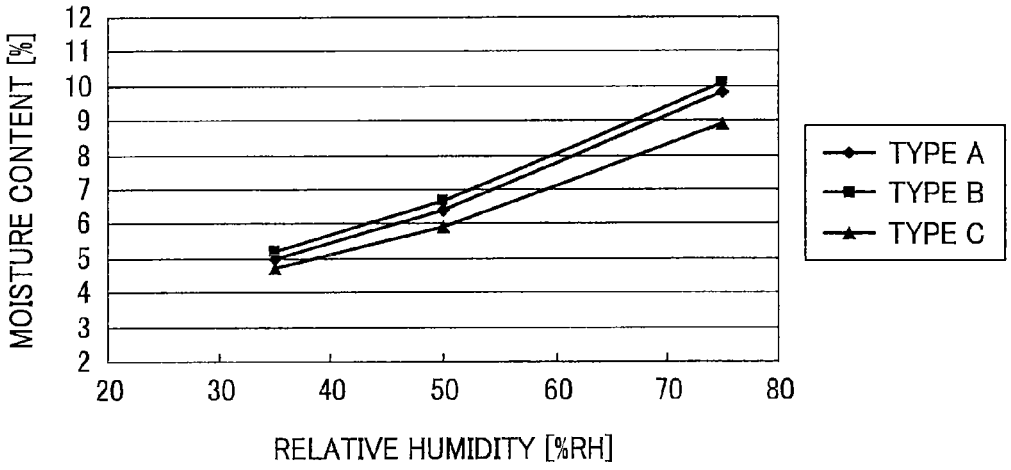
FIG. 8 is a graph of a relationship between the moisture content of the recording paper and relative humidity.

FIG. 8 is a graph of a relationship between the moisture content of the recording paper and relative humidity. As shown in FIG. 8, the moisture content of the recording paper and the relative humidity exhibit excellent correlation; however, a relational expression (straight line) indicating the correlation is different according to the type of the recording paper. It is because there is a difference in water absorbability according to the type of the recording paper.

Figure 9:
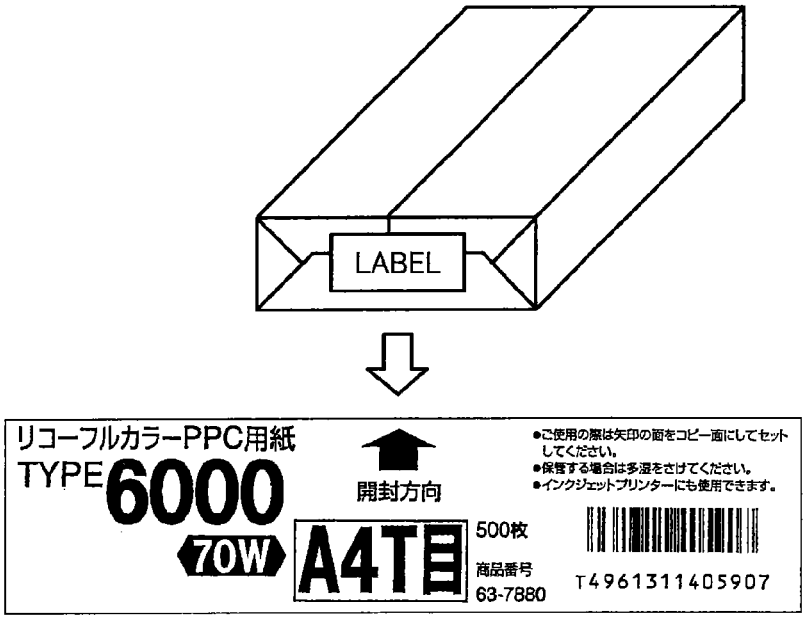
FIG. 9 is a perspective view of a recording paper product.

The relational expressions respectively indicating a relationship between the moisture content and the relative humidity are stored in the data storage unit for the recording paper of various types commercially available from various manufacturers. The type-information obtaining unit that obtains the type information of the recording paper is provided in the copying machine. As the type-information obtaining unit, the one that obtains the type information by an input operation of the user can be considered; however, time and labor are required for inputting the type information. In the copying machine, therefore, the one that obtains the type information by reading item number in a label attached to a package of the recording paper product is used. Specifically, as shown in FIG. 9, the recording paper product is commercially available in a form packed in a unit of several hundreds by wrapping paper (package), and the item number of the recording paper and a barcode indicating the item number is attached to the wrapping paper. Because the item number is different corresponding to the type of the recording paper, the item number can be used as the type information. Therefore, the item number is used as the type information.

Figure 10:
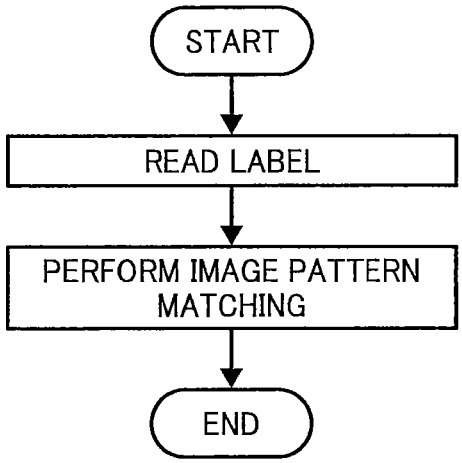
FIG. 10 is a flowchart of a reading process in a configuration in which an item number is indirectly read by image pattern matching.
Figure 11:
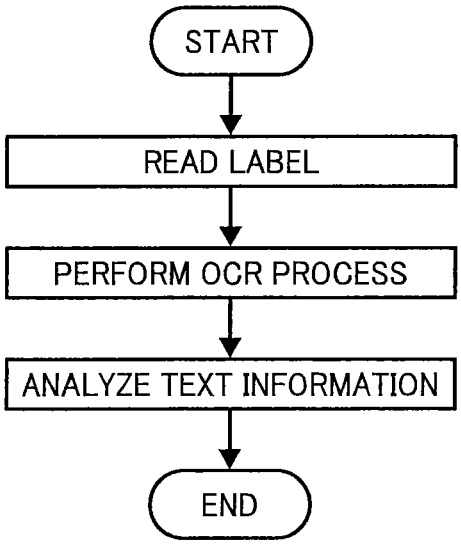
FIG. 11 is a flowchart of a reading process in a configuration in which a character string image of the item number included in a label image is read as a character by known OCR processing.
Figure 12:
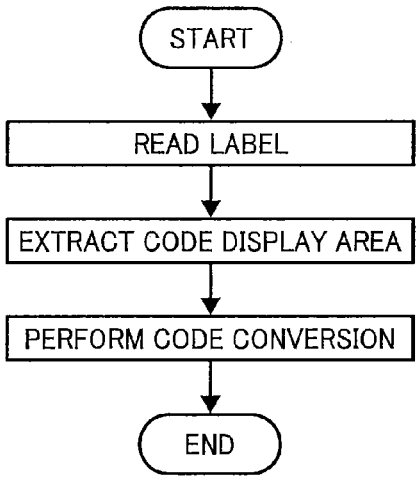
FIG. 12 is a flowchart of a reading process in a configuration in which a barcode image portion in the label image is specified, and the item number is read based on a gap between bar images in the barcode image portion.

A well-known barcode reader that reads the barcode of the item number can be used as a unit that reads the item number. A unit that reads the item number from a label image read by the scanner can be also used. As a method for reading the item number from the label image, as shown in a flowchart in FIG. 10, a method of indirectly reading the item number by image pattern matching can be used. Specifically, it is analyzed with which of a plurality of label sample images stored beforehand in the data storage unit the entire label image read by the scanner matches (image pattern matching). The item number corresponding to the matched label sample image is specified from the data table stored beforehand in the data storage unit, to indirectly read the item number from the pattern of the entire label image. As shown in a flowchart in FIG. 11, a method of reading a character string image of the item number included in the label image as a character by a well-known optical character reader (OCR) process can be used. As shown in a flowchart in FIG. 12, a method of specifying a barcode image portion in the label image, to read the item number based on a gap between a bar images of the barcode image portion can be also used.

Figure 13:
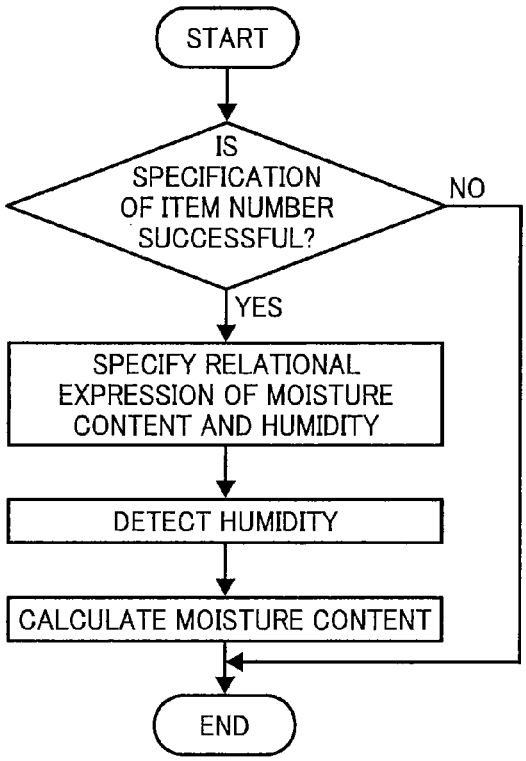
FIG. 13 is a flowchart of a moisture content specifying process.

When the item number is read, a moisture content specifying process as shown in a flowchart in FIG. 13 is performed. In the moisture content specifying process, it is first determined whether specification of the item number is successful. When the item number is not read well, or even if the item number is read, the relational expression (straight line) of the moisture content and the relative humidity corresponding to the item number is not in the data storage unit, specification of the item number is unsuccessful. In other words, a successful case of the item number is when the item number is read well, and the relational expression (straight line) of the moisture content and the relative humidity corresponding to the item number is in the data storage unit. When the item number cannot be specified, it is difficult for the user to obtain the relational expression of the moisture content and the relative humidity. Therefore, the process finishes without specifying the item number. In this case, correction of the parameter based on the moisture content is not performed. On the other hand, when specification of the item number is successful, the relational expression of the moisture content and the relative humidity corresponding to the item number is specified. Further, the humidity is detected by a humidity detection sensor. The detection result is then substituted into the above relational expression, to calculate the moisture content.

According to the copying machine having the above configuration, the moisture content of the recording paper can be obtained without using an expensive moisture sensor.

The copying machine according to the second embodiment of the present invention is explained next. The basic configuration of the copying machine according to the second embodiment is the same as that of the copying machine according to the first embodiment, unless otherwise specified. In the copying machine according to the second embodiment, the method of obtaining the winding index value by the user is the same as that in the reference mode, unless otherwise specified.

In the copying machine, the formulae of the first to tenth principal components and the multiple regression equation are established based on the experiment results for the prints of a different combination of the image area of the toner image and the bending stiffness of the recording paper (hereinafter, "image and bending stiffness combination"), which are then stored in the data storage unit. A stiffness detecting unit that detects the bending stiffness of the recording paper is provided. The stiffness detecting unit will be explained in detail in respective examples described later.

Processing described below is performed by the controller every time the user performs printing. That is, the controller obtains the bending stiffness of the recording paper to be used for printing by the bending stiffness obtaining unit. The controller specifies to which of the "image and bending stiffness combination" stored in the data storage unit the combination of the bending stiffness and the image area approximates most, which is then stored as an "approximation combination". The controller then obtains the 701 pieces of data with the progress of the printing operation, and calculates the first to tenth principal component scores by substituting the time-series detection data into the formulae of the first to tenth principal components in the "approximation combination" stored beforehand in the data storage unit. After calculating the winding index value by substituting these principal component scores into the multiple regression equation, the controller compares the calculation result with the preliminary threshold or the notified threshold.

In such a configuration, the bending stiffness indicating the digitized stiffness itself is detected as the parameter indicating the stiffness of the recording paper, and the winding index value is obtained based on the detection result, thereby enabling to determine the winding index value highly accurately, as compared to the copying machine according to the first embodiment.

In the copying machine, the lubricant is applied to the fixing roller 61 based on a fact that the winding index value has exceeded the preliminary threshold, as in the copying machine according to the first embodiment. It is determined whether winding of the recording paper will occur in each print, during a period since notified of the message urging the replacement of the fixing roller 61 until it is replaced, and when it is determined that winding will occur, the printing operation is suspended.

Also in the copying machine, the winding index value can be determined based on the MTS method instead of the principal component analysis.

Respective examples in which more characteristic configuration is added to the copying machine according to the second embodiment are explained next.

Figure 14:
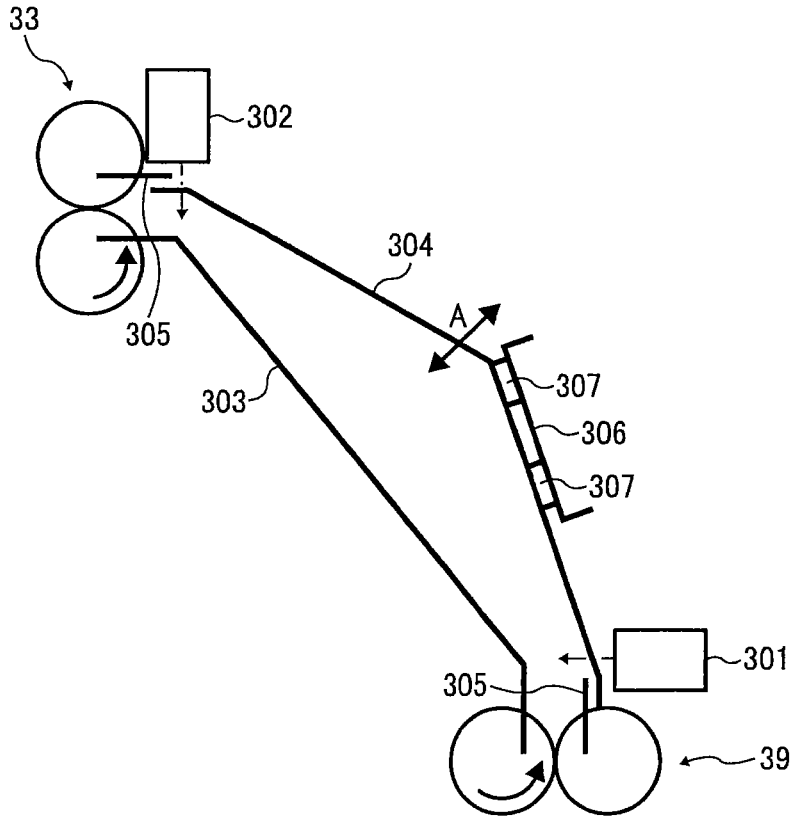
FIG. 14 is an enlarged configuration diagram of a curvature guide as a curvature guiding unit in a copying machine according to a first example.
Figure 15:
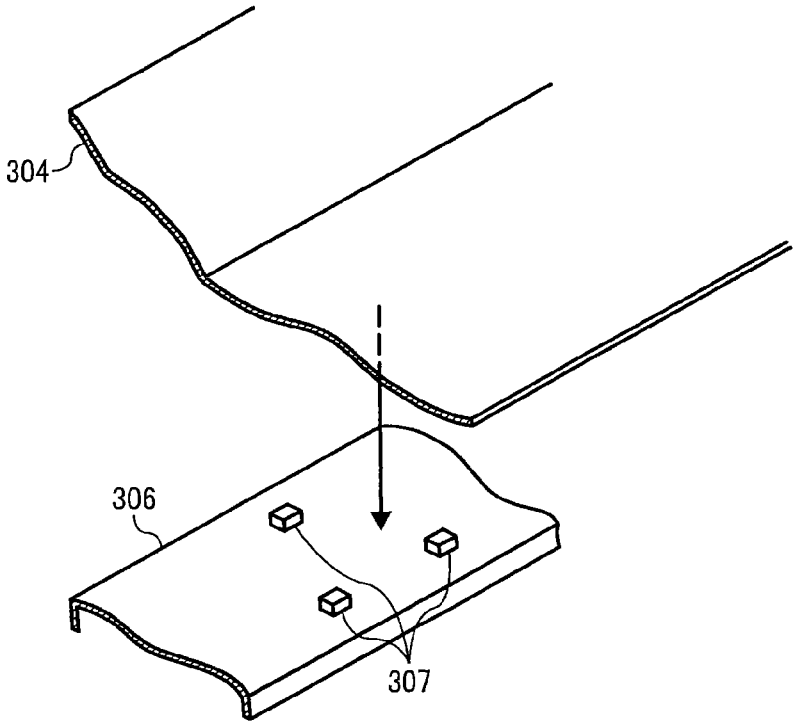
FIG. 15 is an exploded perspective view of the curvature guide.

FIG. 14 is an enlarged configuration diagram of a curvature guide as a curvature guiding unit in a copying machine according to a first example. The curvature guide is arranged between the registration rollers 33 and a pair of conveying rollers 39 adjacent thereto on an upstream side thereof in the feeding direction of the recording paper. The curvature guide includes a lower guide plate 303 that guides the recording paper while supporting the recording paper from the lower side of a direction of gravitational force, an upper guide plate 304 arranged to abut against the surface of the recording paper from the upper side of the direction of gravitational force, and an upper-guide support member 305. A curved conveying path that curves along the feeding direction of the recording paper is formed between the lower guide plate 303 and the upper guide plate 304. The curved conveying path guides the recording paper while inflecting the recording paper in the feeding direction.

A plurality of pressure sensors 307 fixed on a sensor support surface of a sensor support plate 306 is arranged near the upper guide plate 304. These pressure sensors 307 are fixed at positions extending in a lengthwise direction and a widthwise direction of the support surface on the sensor support face of the sensor support plate 306, to form a planar virtual contact surface.

In FIG. 14, the upper guide plate 304 is displaceably supported by the upper-guide support member 305 in a direction of arrow in FIG. 14. However, in a state that there is no recording paper in the curved conveying path, displacement thereof is latched at a position where the other side of a face opposite to the curved conveying path is softly touched by the respective pressure sensors 307 fixed to the sensor support plate 306. When the recording paper approaches the curved conveying path, the curved recording paper presses the upper guide plate 304 against the pressure sensor 307 due to the stiffness of the recording paper. The detection value (sensor output) of the pressure by the respective pressure sensors 307 then increases.

When the tip of the recording paper is inserted into a registration nip of the registration rollers 33, the feed of the recording paper is temporarily suspended for synchronizing the recording paper and the toner image on the intermediate transfer belt at the secondary transfer nip. At this time, the most part of the rear end side of the recording paper is positioned in the curved conveying path to press the upper guide plate 304 toward the pressure sensors 307. The controller obtains sensor output values of the pressure sensors 307 at this time only for a predetermined time, to thereby obtain sensor output mean values within a temporary suspension time. When having obtained the sensor output mean values within a temporary suspension time for respective pressure sensors 307, the controller calculates these mean values and designates these as an average sensor output.

Figure 16:
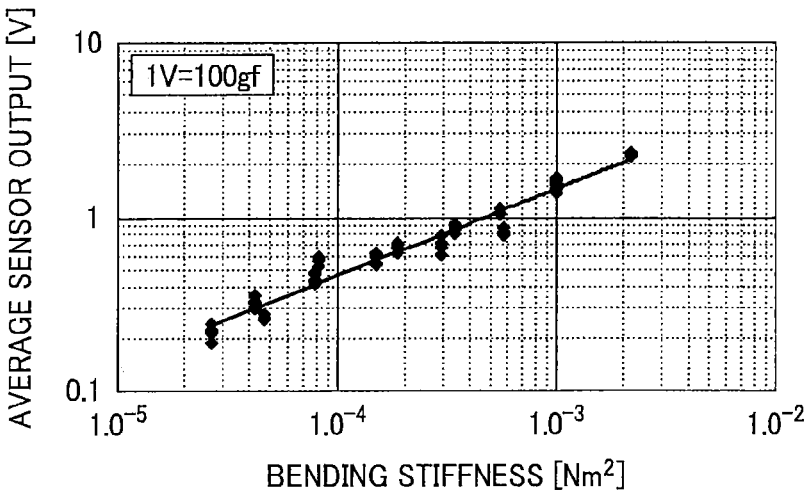
FIG. 16 is a graph of an output mean value of a pressure sensor and the bending stiffness in a temporary suspension period.

In such a configuration, the average sensor output value and the bending stiffness of the recording paper exhibit excellent correlation as in a graph in FIG. 16 formed based on data obtained by experiments by the present inventors. The average sensor output value can be used as an alternative property of the bending stiffness. The controller uses the average sensor output value as the alternative property of the bending stiffness. In this copying machine, the formulae of the first to tenth principal components and the multiple regression equation are established based on the experiment results for the prints of a different combination of the image area of the toner image and the average sensor output value (hereinafter, "image and average output combination"), which are then stored in the data storage unit.

Processing described below is performed by the controller every time the user performs printing. That is, the controller obtains the average sensor output value based on the output value from the respective pressure sensors 307 during temporary suspension of registration. The controller also calculates the image area of the toner image to be printed based on the image information. The controller specifies to which of the "image and average output combination" stored in the data storage unit the combination of the average sensor output value and the image area approximates most, which is then stored as an "approximation combination". Thereafter, the controller calculates the winding index value in the same manner as in the second embodiment and compares the calculation result with the preliminary threshold or the notified threshold.

As the upper guide plate 304, the one having a width larger than that of the recording paper of the largest size that can be stored in the paper feed cassette as the recording member storing unit is used. This is due to the reason described below. That is, the bending stiffness of the recording paper is generated over the entire width of the recording paper. Nevertheless, when the upper guide plate 304 having a smaller width than that of the recording paper of the largest size is used, there is an area that does not come in contact with the upper guide plate 304 in the width direction of the recording paper, in the recording paper having the largest size. The pressure, which is the alternative property of the bending stiffness, is then detected to be lower than the actual value. Therefore, the upper guide plate 304 wider than the width of the recording paper of the largest size is used. In such a configuration, a decrease of the detection accuracy of the bending stiffness due to no contact of a partial area in the width direction of the recording paper with the upper guide plate 304 can be avoided.

A relational expression indicating a relationship between the pressure and the bending stiffness can be stored in the data storage unit beforehand, so that the bending stiffness is obtained based on the measurement result of the pressure and the relational expression. In this case, the formulae of the first to tenth principal components and the multiple regression equation are established based on the experiment results for the prints of a different combination of the image area of the toner image and the bending stiffness (hereinafter, "image and stiffness combination") and these are stored in the data storage unit, respectively.

In a copying machine according to a second example, the curved conveying path is also formed between the lower guide plate 303 and the upper guide plate 304; however, the upper guide plate 304 is undisplaceable. Instead, an impact detecting unit that detects an impact when the recording paper curved in the curved conveying path abuts against the upper guide plate 304 is provided.

Figure 17:
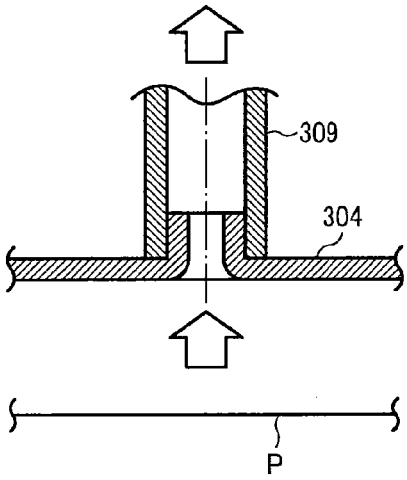
FIG. 17 is an enlarged sectional view of an upper guide plate of a copying machine according to a second example.

As the impact detecting unit, the one that detects a pressure difference between immediately before the recording paper abuts against the upper guide plate 304 and an abutting moment can be mentioned. For example, as shown in FIG. 17, the impact detecting unit has such a configuration that it is connected to a pipe member 309 communicating with a pressure detection hole provided in the upper guide plate 304 coming in contact with the recording paper P in the curved conveying path, to detect a difference of atmospheric pressure in the pipe member 309, when the recording paper P abuts against the circumference of pressure detection light. It is because the difference of atmospheric pressure and the bending stiffness of the recording paper exhibit excellent correlation. A microphone that detects sound can be used instead of the difference of atmospheric pressure.

As the impact detecting unit, an acceleration sensor that detects acceleration at the time of contact when the acceleration sensor comes in contact with the recording paper in the curved conveying path can be used. It is because a rate of acceleration at the time of contact and the bending stiffness of the recording paper exhibit excellent correlation.

The controller uses the detection result of the impact as the alternative property of the bending stiffness. In this copying machine, the formulae of the first to tenth principal components and the multiple regression equation are established based on the experiment results for the prints of a different combination of the image area of the toner image and the impact (hereinafter, "image and impact combination"), and these are stored in the data storage unit.

Processing described below is performed by the controller every time the user performs printing. That is, the controller obtains a detection result by the impact detecting unit when the recording paper abuts against an impact measurement point of the upper guide plate 304. The controller also calculates an image area of the toner image to be printed based on the image information. The controller specifies to which of the "image and impact combination" stored in the data storage unit the combination of the impact and the image area approximates most, which is then stored as an "approximation combination". The controller then calculates the winding index value in the same manner as in the second embodiment, and compares the calculation result with the preliminary threshold and the notified threshold.

A relational expression indicating a relationship between the impact and the bending stiffness can be stored in the data storage unit beforehand so that the bending stiffness is obtained based on the detection result of the impact and the relational expression. In this case, the formulae of the first to tenth principal components and the multiple regression equation are established based on the experiment results for the prints of a different "image and stiffness combination", and these are stored in the data storage unit, respectively.

Also in a copying machine according to a third example, a curved conveying path is formed between the lower guide plate 303 and the upper guide plate 304; however, the upper guide plate 304 is undisplaceable. The feeding time of the recording paper in the curvature guide is detected, and the result thereof is designated as the alternative property of the bending stiffness.

Figure 18:
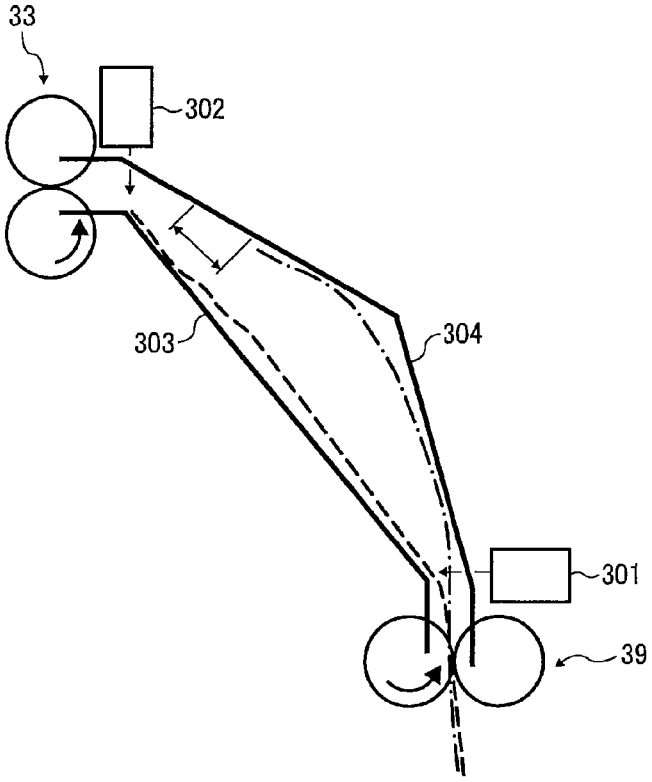
FIG. 18 is an enlarged configuration diagram of a curvature guide in a copying machine according to a third example.

FIG. 18 is an enlarged configuration diagram of the curvature guide as a curvature guiding unit in the copying machine according to the third example. An approach detection sensor 301 including a reflecting photosensor or the like that detects the tip of the recording paper immediately after passing through the transfer nip of the conveying rollers 39 and advancing into the curved conveying path is arranged on the right side of the upper guide plate 304 in FIG. 18. A detection opening (not shown) is provided in the upper guide plate 304 at a position opposite to the approach detection sensor 301, so that the tip of the recording paper can be detected by the approach detection sensor 301.

An ejection detection sensor 302 including the reflecting photosensor or the like that detects the tip of the recording paper immediately before advancing into the registration nip near a downstream end in the feeding direction of the curved conveying path, that is, immediately before the recording paper is ejected from the curved conveying path is arranged on the right side of the registration rollers 33 in FIG. 18. A detection opening (not shown) is provided in the upper guide plate 304 at a position opposite to the ejection detection sensor 302, so that the tip of the recording paper can be detected by the ejection detection sensor 302.

The time since detection of the tip of the recording paper by the approach detection sensor 301 until detection of the tip of the recording paper by the ejection detection sensor 302 is substantially the same as the feeding time of the recording paper in the curvature guide.

The dotted line in FIG. 18 indicates a movement locus in the curvature guide of the recording paper having a relatively low bending stiffness. One-dot chain line indicates the movement locus in the curvature guide of the recording paper having a relatively high bending stiffness. The recording paper having a relatively low bending stiffness moves along near the inside of the curve in the curved conveying path of the curvature guide. On the other hand, the recording paper having a relatively high bending stiffness moves along near the outside of the curve in the curved conveying path. Accordingly, the higher the bending stiffness of the recording paper, the longer the feeding time. As shown in FIG. 18, within the time during which the tip of the recording paper having a relatively low bending stiffness moves up to a detection position by the ejection detection sensor 302, the tip of the recording paper having a relatively high bending stiffness is positioned on an upstream side in the paper feeding direction than the detection position.

Figure 19:
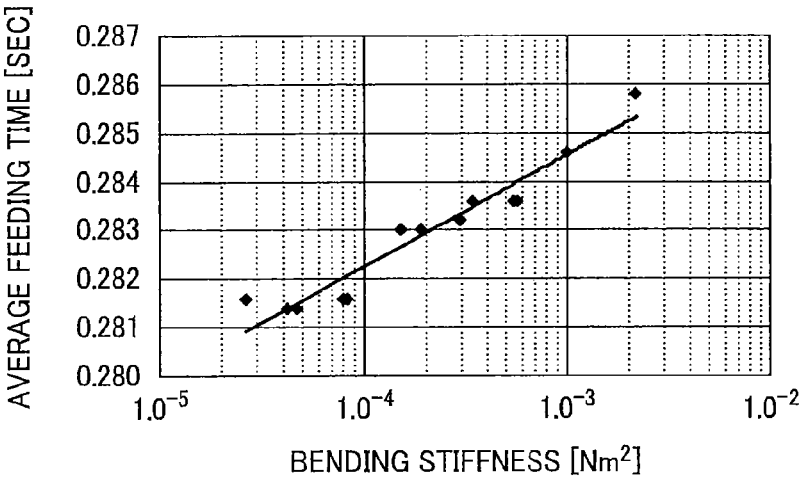
FIG. 19 is a graph of a relationship between an average feeding time obtained by averaging results of measurement of the feeding time and bending stiffness, for a plurality of recording paper having the same bending stiffness.

FIG. 19 is a graph of a relationship between the average feeding time obtained by averaging results of measurement of the feeding time and the bending stiffness, for a plurality of recording paper having the same bending stiffness. As shown in FIG. 19, the length of the average feeding time and the bending stiffness exhibit excellent correlation.

When the recording paper is fed out of the paper feed cassette, a feeding-time measuring unit including the controller, the approach detection sensor 301, the ejection detection sensor 302, and the like measures the feeding time of the recording paper in the curved conveying path. The controller uses the measurement result as the alternative property of the bending stiffness. In this copying machine, the formulae of the first to tenth principal components and the multiple regression equation are established based on the experiment results for the prints of a different combination of the image area of the toner image and the feeding time (hereinafter, "image and feeding time combination"), and these are stored in the data storage unit.

Processing described below is performed by the controller every time the user performs printing. That is, the controller measures the feeding time of the recording paper in the curved conveying path. The controller also calculates the image area of the toner image to be printed based on the image information. The controller specifies to which of the "image and feeding time combination" stored in the data storage unit the combination of the feeding time and the image area approximates most, which is then stored as an "approximation combination". The controller then calculates the winding index value in the same manner as in the second embodiment, and compares the calculation result with the preliminary threshold and the notified threshold.

A relational expression indicating a relationship between the feeding time and the bending stiffness can be stored in the data storage unit beforehand to obtain the bending stiffness based on the measurement result of the feeding time and the relational expression. In this case, the formulae of the first to tenth principal components and the multiple regression equation are established based on the experiment results for the prints of a different "image and stiffness combination" and these are stored in the data storage unit.

Because the pressure by the recording paper curving in the curved conveying path decreases as the recording paper slips in the transfer nip of the conveying rollers 39, the slip can be detected by detecting the decrease.

Figure 20:
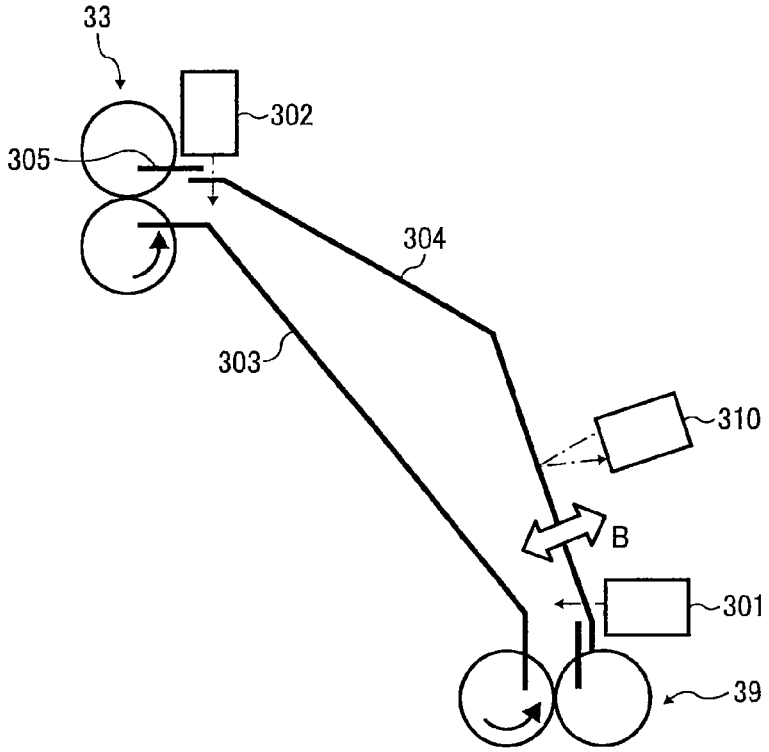
FIG. 20 is an enlarged configuration diagram of a curvature guide in a copying machine according to a fourth example.

FIG. 20 is an enlarged configuration diagram of a curvature guide in a copying machine according to a fourth example. The upper guide plate 304 is supported by the upper-guide support member 305 displaceably in a direction of arrow in FIG. 20. A coil spring (not shown) is present between the upper guide plate 304 and the upper-guide support member 305, and biases the upper guide plate 304 toward the lower guide plate. The upper guide plate 304 is biased by the coil spring to abut against a stopper (not shown), so that a distance between the upper guide plate 304 and the lower guide plate 303 does not become smaller than a lower limit. When the recording paper advancing into the curved conveying path abuts against the upper guide plate 304, the upper guide plate 304 is moved outward of the conveying path against the biasing force of the coil spring.

Figure 21:
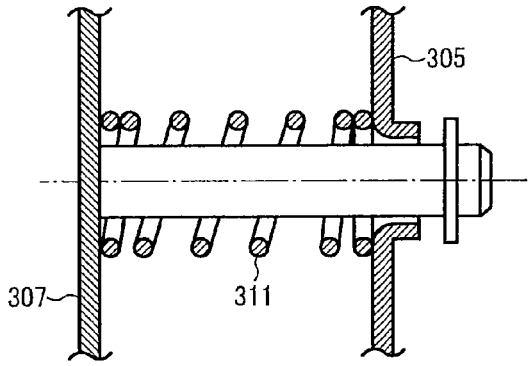
FIG. 21 is an enlarged configuration diagram of one example of a single coil spring provided in an upper-guide-plate biasing unit of the copying machine.
Figure 22:
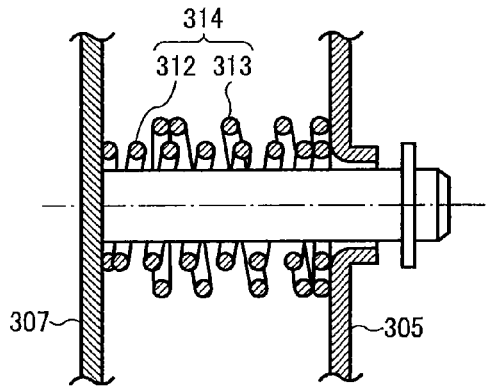
FIG. 22 is an enlarged configuration diagram of one example of a parallel coil spring provided in the upper-guide-plate biasing unit.
Figure 23:
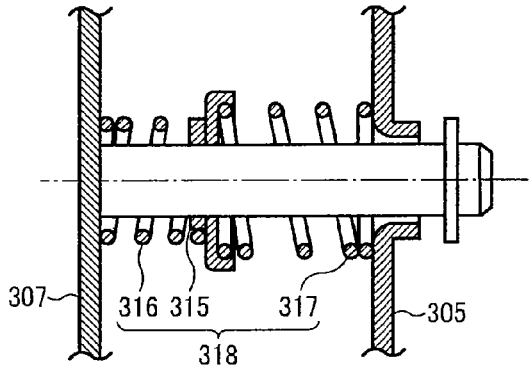
FIG. 23 is an enlarged configuration diagram of one example of a series coil spring provided in the upper-guide-plate biasing unit.

As the coil spring, a single coil spring 311 single-turned as shown in FIG. 21, with a spiral pitch being different between a center and an end in an expansion and contraction direction, can be used. A compound parallel spring 314 as shown in FIG. 22 can be also used. In the compound parallel spring 314, a first coil spring 312 having a relatively small spring constant and a second coil spring 313 having a relatively large spring constant are provided in parallel position so that only the first coil spring 312 is contracted when a shrinkage is relatively small, and when the shrinkage is relatively large, the both coil springs are contracted. A compound series spring 318 as shown in FIG. 23 can be used. In the compound series spring 318, a first coil spring 316 having a relatively small spring constant and a second coil spring 317 having a relatively large spring constant are connected in serial position via a connecting member 315. When the shrinkage is relatively small, the first coil spring 316 having a relatively small spring constant is mainly contracted. On the other hand, when the shrinkage is relatively large, the second coil spring 317 is also contracted.

Figure 24:
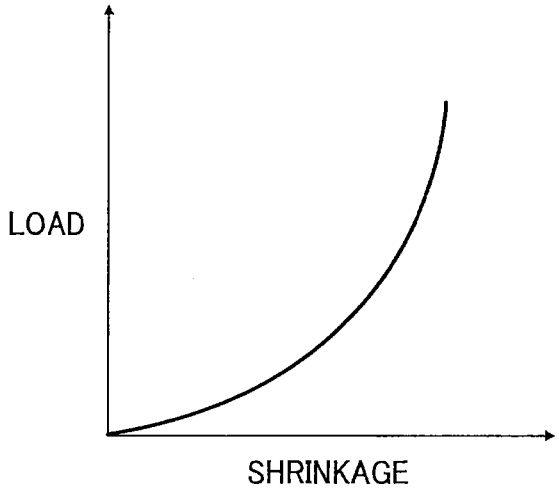
FIG. 24 is a graph of a characteristic of the single coil spring.
Figure 25:
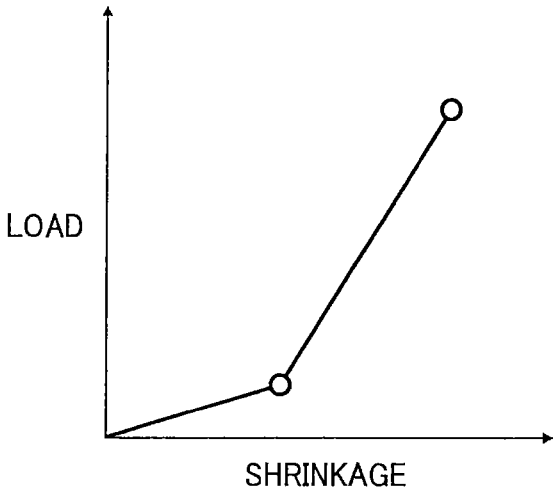
FIG. 25 is a graph of characteristics of the compound parallel spring and a compound series spring.

The single coil spring 311 shown in FIG. 21 has a characteristic, as shown in FIG. 24, in which the shrinkage changes along a nonlinear graph with respect to application of load in a contraction direction. Further, the compound parallel spring 314 shown in FIG. 22 and the compound series spring 318 shown in FIG. 23 have a characteristic, respectively, as shown in FIG. 25, in which the shrinkage changes along a linear graph with respect to application of load in the contraction direction. Application of load in these figures corresponds to the bending stiffness of the recording paper in the curved conveying path. That is, the higher the bending stiffness of the recording paper, the larger the shrinkage.

In FIG. 20, a displacement sensor 310 as a displacement detecting unit is arranged on the right side of the upper guide plate 304 to detect a displacement of the upper guide plate 304 that moves when the recording paper advancing into the curved conveying path abuts against the upper guide plate 304. The displacement and the bending stiffness of the recording paper exhibit excellent correlation.

When the recording paper is fed out of the paper feed cassette, the controller obtains the detection result by the displacement sensor 310 when the feeding of the recording paper is temporarily suspended in a state with the tip of the recording paper being inserted into the registration rollers 33, and uses the detection result as the alternative property of the bending stiffness. In this copying machine, the formulae of the first to tenth principal components and the multiple regression equation are established based on the experiment results for the prints of a different combination of the image area of the toner image and the detection result (hereinafter, "image and displacement combination") and these are stored in the data storage unit.

Processing described below is performed by the controller every time the user performs printing. That is, the controller obtains the detection result by the displacement sensor 310 in a state with the feeding being temporarily suspended in the registration rollers 33. The controller also calculates the image area of the toner image to be printed based on the image information. The controller specifies to which of the "image and displacement combination" stored in the data storage unit the combination of the displacement and the image area approximates most, which is then stored as an "approximation combination". Thereafter, the controller calculates the winding index value in the same manner as in the second embodiment and compares the calculation result with the preliminary threshold or the notified threshold.

A relational expression indicating a relationship between the displacement and the bending stiffness can be stored in the data storage unit beforehand to obtain the bending stiffness based on the detection result of the displacement and the relational expression. In this case, the formulae of the first to tenth principal components and the multiple regression equation are established based on the experiment results for the prints of a different "image and stiffness combination" and these are stored in the data storage unit.

Figure 26:
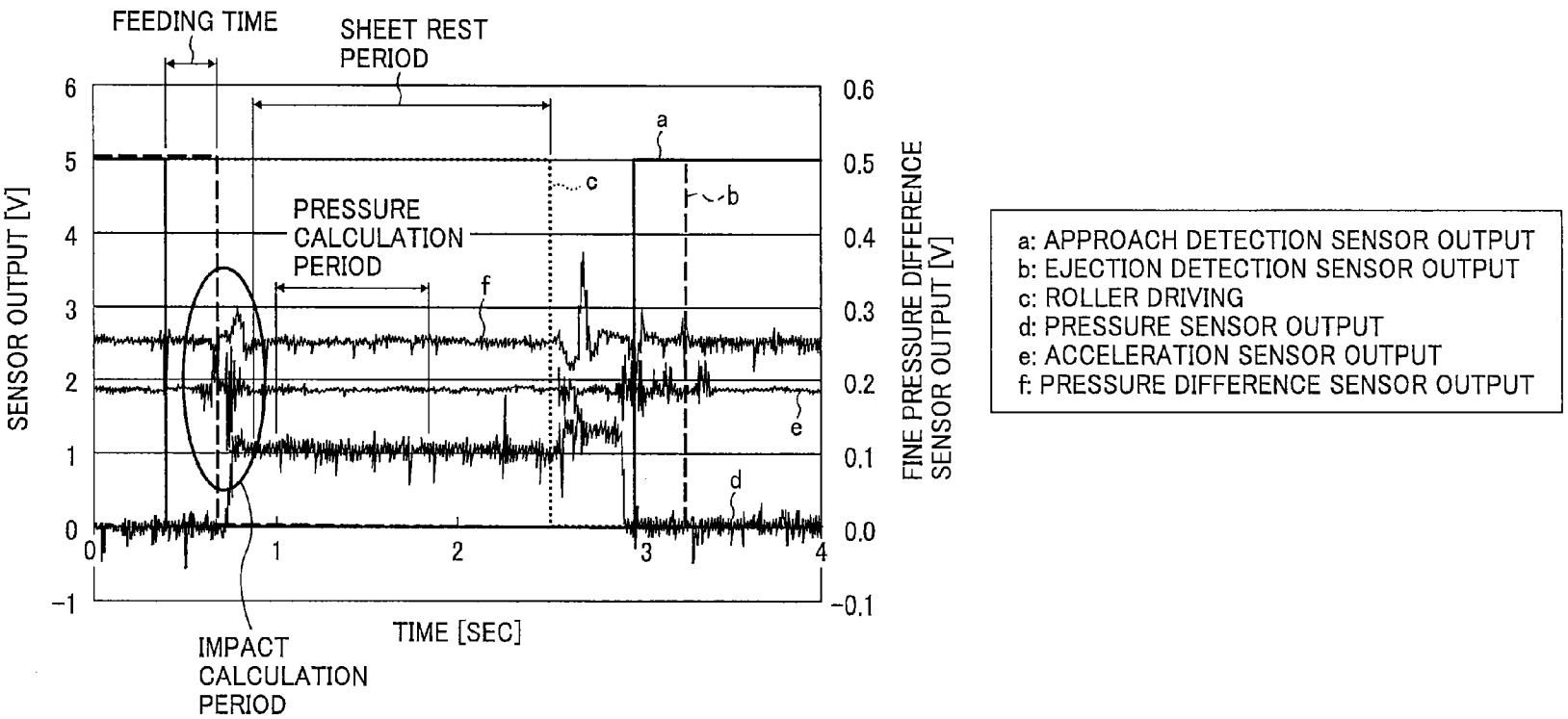
FIG. 26 is a graph of a change with the lapse of time of output values from sensors.

FIG. 26 is a graph of a change with the lapse of time of the output value from the respective sensors. As shown in FIG. 26, in a configuration for detecting the impact by the acceleration sensor or an atmospheric-pressure difference sensor, the bending stiffness can be detected in a short time, because a peak value of a rapid change in the acceleration or the atmospheric pressure difference generated near the end of the feeding time needs only to be detected. In a configuration for detecting the pressure by the pressure sensor, a mean value of the detection results in a certain period needs to be obtained for reducing a detection error due to slight fluctuation of the detection results; however, a complicated process of analyzing the peak value is not required. Although not shown in FIG. 26, the same thing applies to a case that the displacement is detected by the displacement sensor. In the configuration for measuring the feeding time, because existing devices such as the registration sensor (used as the ejection detection sensor) or a timing unit can be used, the bending stiffness of the recording paper can be ascertained at a low cost.

An example of the copying machine that forms the toner image by the electrographic system has been explained above; however, the present invention can be applied also to an image forming apparatus that forms a toner image by a direct recording system. The direct recording system is for forming the toner image by directly attaching a toner group being ejected from a toner ejecting device to the recording member, not relying on the latent image carrier, as in the image forming apparatus described in, for example, Japanese Patent Application Laid-open No. 2002-307737.

Further, the copying machine that obtains windability of recording paper with respect to the fixing roller 61 has been explained above. However, the windability with respect to not only the fixing roller 61 but also the conveying member that forms a nip in the post-recording channel can be obtained. For example, in a pair of conveying members including the intermediate transfer belt 25 as the conveying member and the paper conveying belt 29 as the conveying member, the windability of the recording paper with respect to the intermediate transfer belt 25 can be obtained.

In the copying machine according to the example in the first embodiment, the controller as the index-value calculating unit is configured such that the controller obtains the parameter indicating the stiffness of the recording paper based on the thickness information and the width information of the recording paper, to calculate the winding index value based on the image area of the toner image, the time-series detection data as the behavior, and the parameter. In such a configuration, the volume of data can be reduced by bringing the thickness information and the width information into one parameter.

Further, in the copying machine, the moisture sensor as the moisture-content detecting unit that detects the moisture content of the recording paper and the controller as the correcting unit that corrects the parameter based on the moisture content are provided. In such a configuration, as explained above, the winding index value can be obtained more accurately by reducing an inappropriate parameter due to a difference in the moisture content of the recording paper by correcting the parameter. Accordingly, the wearing of the fixing roller 61 can be determined highly accurately.

Further, in the copying machine according to the modification, the humidity sensor as the humidity detecting unit that detects the humidity, the type-information obtaining unit that obtains the type information of the recording paper, and the controller as the correcting unit are configured such that the parameter is corrected based on the detection result by the humidity sensor and the obtained result by the type-information obtaining unit. In such a configuration, the moisture content of the recording paper can be ascertained without using an expensive moisture sensor, and the parameter can be corrected appropriately.

Further, in the copying machine according to the first and second embodiments, the controller as a predicting unit that predicts whether the recording paper whose thickness information and width information have been obtained, or the recording paper whose bending stiffness has been detected causes winding with respect to the fixing roller 61 as the conveying member is provided, and the printing operation is suspended based on the prediction result thereof. As explained above, in such a configuration, wasteful toner consumption can be reduced by forcibly suspending the printing operation, when the possibility of winding is high.

Further, in the copying machine according to the first embodiment, the stiffness detecting unit includes the curvature guide as the curvature guiding unit that guides the recording paper in the feeding direction while inflecting the recording paper, and the pressure sensor 307 as the pressure detecting unit that detects the pressure applied to the upper guide plate 304 by a curved portion of the recording paper, to detect the pressure as the alternative property of the bending stiffness is used. In such a configuration, the bending stiffness of the recording paper can be obtained without performing a complicated process of analyzing the peak value of the sensor output.

Further, in the copying machine according to the first example, the paper feed cassette as the recording member storing unit that stores recording paper is provided, and as the curvature guide, the one in which the size in the width direction orthogonal to the paper feeding direction on a contact face with the recording paper is set larger than the size in the width direction of recording paper of the largest size that can be stored in the paper feed cassette is used. In such a configuration, as explained above, a decrease of the detection accuracy of the bending stiffness due to no contact of a partial area in the width direction of the recording paper with the upper guide plate 304 can be avoided.

Further, in the copying machine according to the second example, the stiffness detecting unit includes the curvature guide as the curvature guiding unit that guides the recording paper in the feeding direction, and the impact detecting unit that detects an impact when the curvature guide abuts against a curved portion of the recording paper, to detect the impact as the alternative property of the bending stiffness. In such a configuration, the bending stiffness can be obtained in a short time, because only the peak value of a rapid change of the impact when the recording paper abuts against a portion to be detected of the curvature guide needs to be detected.

In the copying machine according to the third example, the stiffness detecting unit includes the curvature guide as the curvature guiding unit that guides the recording paper in the feeding direction while inflecting the recording paper, and the feeding-time measuring unit that measures the feeding time of the recording paper at a guide position by the curvature guide, to detect the feeding time as the alternative property of the bending stiffness. In such a configuration, because existing devices such as a registration sensor or a timing unit can be used, the bending stiffness of the recording paper can be ascertained at a low cost.

Further, in the copying machine according to the fourth example, the stiffness detecting unit includes the curvature guide as the curvature guiding unit that guides the recording paper in the feeding direction while inflecting the recording paper, a guide holding unit that holds the upper guide plate 304 of the curvature guide displaceably in a curved direction of the recording paper, and the displacement sensor 310 as the displacement detecting unit that detects the displacement of the upper guide plate 304 associated with abutment with a curved portion of the recording paper, to detect the displacement as the alternative property of the bending stiffness. In such a configuration, the bending stiffness of the recording paper can be obtained without performing a complicated process of analyzing the peak value of the sensor output.

In the respective embodiments and examples, the behavior detecting unit includes the laser displacement sensor 67 as a sonic distance detecting unit that detects a distance between the recording paper fed out of the outlet of the fixing nip and the sensor itself by a sonic wave, and the controller as a totaling unit that totals the detection results obtained by the laser displacement sensor 67 in chronological order. In such a configuration, the distance between the recording paper and the sensor can be detected based on reflection of the sonic wave, regardless of the presence of the toner image on the surface of the recording paper. Therefore, the behavior of the recording paper can be detected highly accurately, even at the time of switchback two-side transfer in which the toner image is directed to a surface opposite to the sensor.

In the respective embodiments and examples, an optical distance-detecting unit that optically detects the distance between the recording paper and the unit itself can be used instead of the sonic distance detecting unit. In such a configuration, by making a spot diameter of light emission relatively small, the distance can be detected even if a distance detection target area of the recording paper is relatively small. Therefore, even in a small copying machine having no spare space for installing a sensor, the behavior of the recording paper can be detected without increasing the size of the machine.

According to one aspect of the present invention, different from a conventional copying machine in which the index value of windability of the recording member with respect to the conveying member is obtained by using only the thickness of the recording member as the parameter indicating the stiffness of the recording member, the index value is obtained by using the thickness and the width of the recording member as the parameter. Accordingly, the index value can be calculated more accurately than in the conventional copying machine, and the wearing of the conveying member can be determined highly accurately.

Furthermore, according to another aspect of the present invention, different from the conventional copying machine in which the index value is obtained by using only the thickness of the recording member as the parameter indicating the stiffness of the recording member, the index value is obtained by using, as the parameter, the bending stiffness indicating the digitized stiffness itself of the recording member. Accordingly, the index value can be calculated more accurately than in the conventional copying machine, and the wearing of the conveying member can be determined highly accurately. Further, because the bending stiffness indicates the digitized stiffness of the recording member more accurately than the combination of the thickness and the width of the recording member, the index value can be calculated more accurately and the wearing of the conveying member can be determined with a high accuracy than in conventional copying machines.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a controller which controls an image forming unit configured to form a toner image on a recording member, an area calculating unit configured to calculate an image area of the toner image, a pair of conveying members configured to form a conveying nip for conveying the recording member when the toner image is being formed or after the toner image is formed, a lubricant application member that selectively applies a lubricant to at least one of the conveying members;

a behavior detecting unit configured to detect behavior of the recording member being fed out of the conveying nip, a thickness obtaining unit configured to obtain thickness information of the recording member, a width obtaining unit configured to obtain width information of the recording member, a stiffness obtaining unit configured to obtain bending stiffness of the recording member based on the thickness information and the width information of the recording member, an index calculating unit configured to calculate an index value, indicating windability of the recording member with respect to the conveying members, for each combination of bending stiffness and image area, wherein the recording member winds around one of the conveying members, based on at least the image area, the behavior and the bending stiffness of the recording member, a wearing determining unit configured to determine wearing of the conveying members based on the index value;

a predicting unit that compares the index value with a preliminary threshold value, and also with a notified threshold that is larger than the preliminary threshold value, to predict whether the recording member whose thickness information is obtained causes winding with respect to the conveying members; and a control unit that causes the lubricant application member to apply lubricant to the at least one of the conveying members based on the comparison with the preliminary threshold value, and suspends an image forming operation of the image forming apparatus based on the comparison with the notified threshold value.

2. The image forming apparatus according to claim 1, further comprising:

a moisture-content detecting unit that detects moisture content of the recording member; and a parameter correcting unit that corrects a parameter indicating stiffness of the recording member, based on the moisture content.

3. The image forming apparatus according to claim 1, further comprising:

a humidity detecting unit that detects humidity;

a type obtaining unit that obtains type information on a type of the recording member; and a parameter correcting unit that corrects the parameter indicating stiffness of the recording member, based on the humidity and the type information.

4. The image forming apparatus according to claim 1, wherein the behavior detecting unit includes a distance detecting unit that detects a distance to the recording member fed out of the conveying nip, and a collecting unit that collects a detection result obtained by the distance detecting unit in time series.

5. The image forming apparatus according to claim 4, wherein the distance detecting unit is an optical distance-detecting unit that optically detects the distance to the recording member.

6. The image forming apparatus according to claim 4, wherein the distance detecting unit is a sonic distance detecting unit that detects the distance to the recording member by a sonic wave.

7. The image forming apparatus according to claim 1, wherein the behavior detected by the behavior detecting unit is detected as time-series detection data by a laser displacement sensor.

* * * * *